US007290409B2

(12) United States Patent
Grassi et al.

(10) Patent No.: US 7,290,409 B2
(45) Date of Patent: Nov. 6, 2007

(54) METHOD AND DEVICE FOR HANDLING A TUBULAR KNITTED ARTICLE, IN PARTICULAR A SOCK

(75) Inventors: Nerino Grassi, Mantova (IT); Antonio Magni, Florence (IT)

(73) Assignee: Golden Lady Company S.p.A. (IT)

( * ) Notice: Subject to any disclaimer, the term of this patent is extended or adjusted under 35 U.S.C. 154(b) by 30 days.

(21) Appl. No.: 10/559,716

(22) PCT Filed: Jan. 25, 2005

(86) PCT No.: PCT/IT2005/000036

§ 371 (c)(1),
(2), (4) Date: Dec. 5, 2005

(87) PCT Pub. No.: WO2005/100665

PCT Pub. Date: Oct. 27, 2005

(65) Prior Publication Data

US 2007/0101770 A1 May 10, 2007

(30) Foreign Application Priority Data

Apr. 16, 2004 (IT) ..... FI2004A0090

(51) Int. Cl.
*D04B 9/40* (2006.01)

(52) U.S. Cl. ..... 66/148

(58) Field of Classification Search ..... 66/147, 66/148; 112/470.08, 475.12
See application file for complete search history.

(56) References Cited

U.S. PATENT DOCUMENTS

| | | | | |
|---|---|---|---|---|
| 6,158,367 | A | 12/2000 | Jordan et al. | |
| 6,341,570 | B2 * | 1/2002 | Fujiwara et al. | 112/475.12 |
| 6,516,979 | B1 * | 2/2003 | Migliorini | 223/75 |
| 7,044,071 | B2 * | 5/2006 | Jordan et al. | 112/470.08 |
| 7,049,621 | B2 * | 5/2006 | Bassi | 250/559.4 |

FOREIGN PATENT DOCUMENTS

| | | |
|---|---|---|
| WO | WO 02/070801 | 9/2002 |
| WO | WO 03/018891 | 3/2003 |

* cited by examiner

*Primary Examiner*—Danny Worrell
(74) *Attorney, Agent, or Firm*—McGlew & Tuttle P.C.

(57) ABSTRACT

A method to orient a tubular knitted article, such as a sock or the like, with respect to a pocket of fabric, for example the heel or toe pocket of said article. The method comprises the phases of: stretching an article on a tubular member (1) so that an intermediate part of the band (F) surrounding an end to be sewn of said article (M) is positioned along a line intersecting in two points the end edge of the tubular member and the remaining part is disposed along the outer side surface of the tubular member; detecting the angular position of said band on the tubular member; identifying the position of a pocket of fabric of the article on the basis of the angular position of said band with respect to the tubular member.

33 Claims, 22 Drawing Sheets

Fig. 1
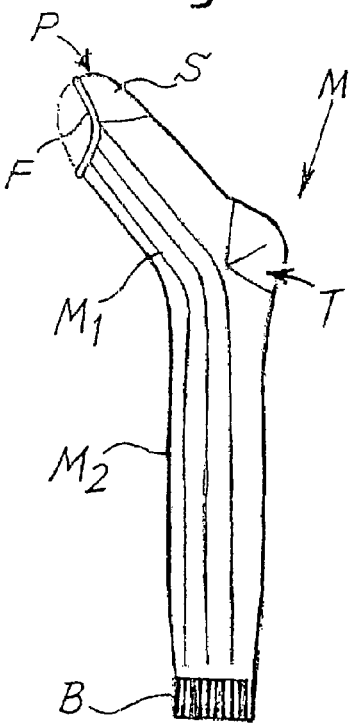
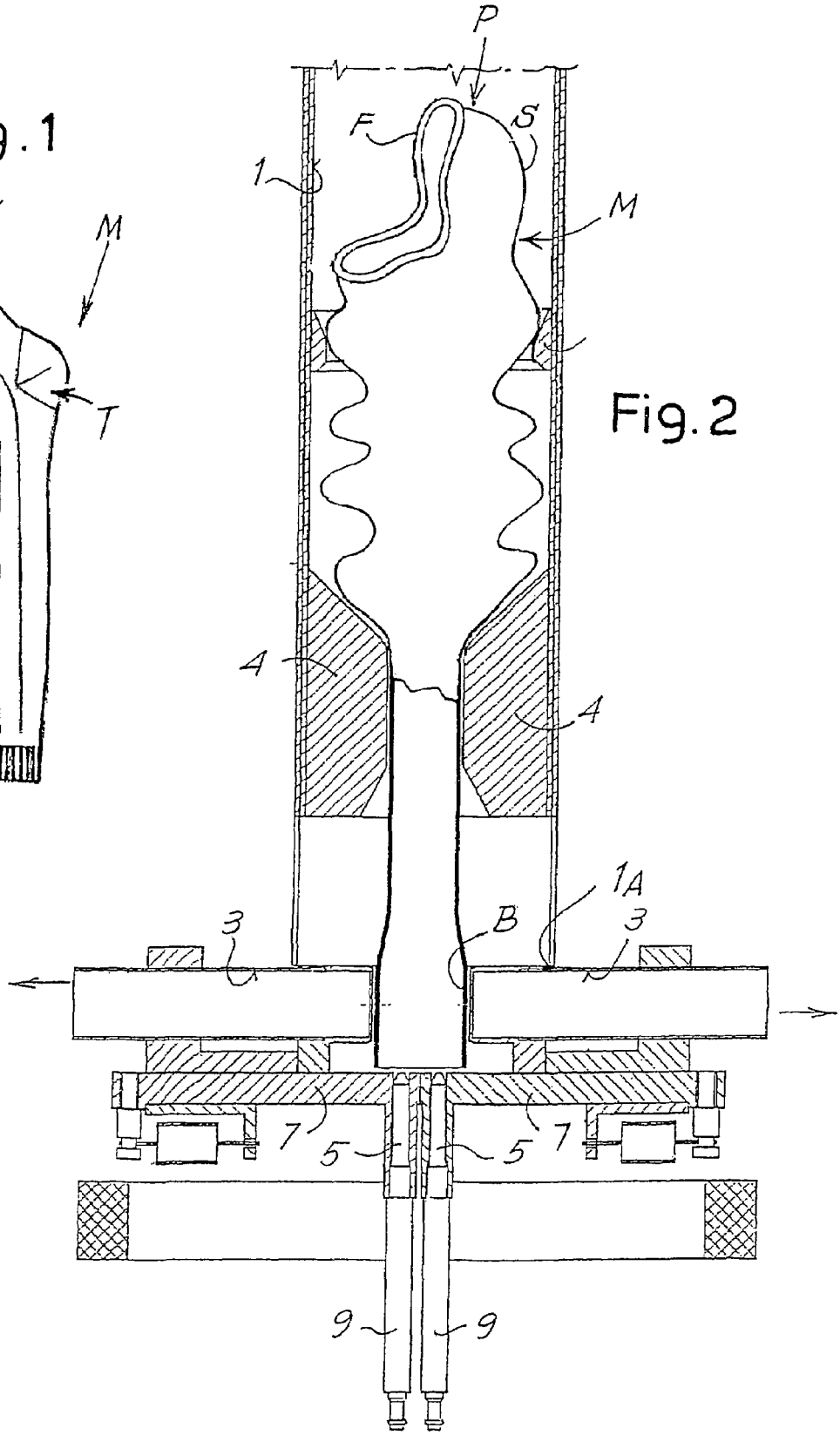
Fig. 2

P
1
F
S
M
3
3
B
4
7
5
4
9
9

P
F
1
S
M
1
4
B
11
11

I
$I_A$
$I_{22}$
$I_{21}$
0°
$\beta_1$
$\beta_M$
$\beta_2$
$\beta_M+180°$
360°
α

$I_2$
$I_1$
$I_A$
$I_{22}$
$I_{21}$
0°
$\beta_M-180°$
$\beta_1$
$\beta_M$
$\beta_2$
α

METHOD AND DEVICE FOR HANDLING A TUBULAR KNITTED ARTICLE, IN PARTICULAR A SOCK

TECHNICAL FIELD

The present invention relates to methods and devices for handling tubular knitted articles, in particular, although not exclusively, socks and stockings.

More specifically, the present invention relates to a method for handling a tubular knitted article, such as a sock or the like, with the object of orienting it with respect to the heel pocket and the toe pocket to close the toe by sewing or linking of said article.

The invention also relates to a device for implementation of the afore-said method.

STATE OF THE ART

To produce stockings, socks and other tubular knitted articles, circular knitting machines are commonly used, which produce—using needle beds disposed on one or two cylinders—semi-finished articles with two ends: one of these ends constitutes the elastic edge and represents the end from which the finished garment is put on. The opposite end, instead, must be sewn or linked once the semi-finished article has been unloaded from the circular machine, to produce the closed toe of said article.

Typically, the article has a first pocket of fabric for the heel and a second pocket of fabric for the toe. Some types of sporting article have no heel pocket and the article has a less modeled shape.

Devices to handle these articles until they are sewn or linked are described, for example, in WO-A-02070801 and in WO-A-03018891.

Sewing or linking with which the final end of the article is closed to form the toe must have an orientation preestablished with respect to the pocket of fabric, produced on the circular machine, forming the heel of the article and/or with respect to the toe pocket, in order to guarantee correct fit of the garment. It is therefore necessary to orient the semi-finished article correctly before picking it up and inserting it in the devices that perform sewing, whether these are linking devices, sewing devices or intermediate devices destined to convey the article to a sewing or linking station.

For this purpose, according to prior art, a band, strip or edge formed of rows of stitches characterized by an area of a different color with respect to the remaining portion of these stitches, is knitted along the edge defining the end destined to form the toe of the finished article. This area constitutes a reference mark for optical orientation sensors and is disposed in a specific position with respect to the toe pocket and/or the heel pocket. This is easily obtainable through the electronic control of the knitting machine.

By rotating the article and the sensor with respect to each other, it is possible to identify the position of the reference mark and therefore of the toe or heel pocket. The article will therefore be engaged in a specific position with respect to the pocket, to be sewn or linked with the correct orientation.

With this method, the production of a mark that can be read by a photo-cell or another optical sensor has some drawbacks. Firstly, on some circular machines (in particular double cylinder circular machines) it is not easy to produce this mark. Secondly, in any case, the use of yarns of different colors to differentiate the mark from the remaining extension of the edge surrounding the end of the semi-finished article to be closed involves an increase in costs and a reduction in the production speed of the circular machine.

U.S. Pat. No. 6,158,367 illustrates an orientation system for socks to be sewn wherein each sock with the toe still open is inserted over a tube and positioned thereon so as to project with the toe pocket beyond the edge of the tube. A double optical sensor, comprising two transmitters and two receivers, is then positioned with respect to the sock so that the two transmitters are essentially positioned aligned with the tube over which the sock is inserted and at the level of the toe pocket. The two transmitters emit optical beams towards corresponding receivers placed outside the volume of the sock. By rotating the two pairs of transmitter-receivers about the axis of the tube the position of the toe pocket is determined. The system illustrated in this prior art patent pre-supposes that the sock has a thickness which allows the toe pocket to project from the tube without sagging. Therefore, operation is somewhat unreliable and strictly dependent on the unpredictable behavior of the fabric with which the sock is produced.

OBJECTS AND SUMMARY OF THE INVENTION

The object of the present invention is to either reduce or totally or partly eliminate the drawbacks of prior art illustrated above.

Essentially, according to the invention, a method is provided to handle a tubular knitted article comprising a first open end defining an elastic edge, a second open end surrounded by a band and which must be closed to form a closed toe of the article, along a closing line having a specific orientation with respect to a pocket of fabric of the article, characterized by the steps of:

- stretching said article over a tubular member so that an intermediate part of the band surrounding said second end is positioned along a line intersecting in two points the end edge of the tubular member and the remaining part is disposed along the outer side surface of the tubular member;
- detecting the angular position of said band on the tubular member;
- identifying the position of the pocket of fabric on the basis of the angular position of said band with respect to the tubular member.

In an advantageous embodiment of the invention, the method includes the steps of:

- determining the angular positions of two portions of said band adjacent to the end edge of the tubular member and disposed on the outer side surface of said tubular member;
- identifying the angular position of the pocket of fabric in the intermediate area between said two angular positions.

In this case, the tubular member can be made to rotate about the axis thereof to determine the angular positions of said two portions of the band during said rotation.

The position of the band can be read using an optical detection system, although other detection systems, for example magnetic or capacitive, would also be possible.

A specific embodiment provides for the steps of:

- positioning at least a first sensor at a first distance from the end edge of the tubular member;
- rotating said tubular member about its axis with the tubular article inserted thereover, until two portions of said band pass in front of said first sensor, determining the angular positions of said two portions on the tubular member;

identifying the angular position of the pocket of fabric in the intermediate angular position between the two angular positions of said two portions of said band.

In an improved embodiment of the invention, a second sensor is provided at a second distance from the end edge of the tubular member and two possible diametrically opposed angular positions of said pocket of fabric are discerned between using the combined detection of said two sensors. Alternatively, distinction between the two possible diametrically opposed angular positions can be made in another way, for example using a sensor capable of recognizing the surface of the fabric and of distinguishing it from the outer surface of the tubular member.

To facilitate recognition of the position of the band on the tubular member, advantageously the color or the band surrounding the opening of the second end of the article can differ from the color of the fabric adjacent to said band.

In another embodiment, the outer surface of the tubular member can have a different surface characteristic (such as a color) to the surface of the fabric of the article. In this case, a single sensor can easily recognize the end and the beginning of the fabric while the tubular member rotates with respect to the sensor.

In a possible embodiment, after identifying the position of the toe pocket of the article, the tubular member supporting it, is rotated to dispose said pocket in a specific angular position. Subsequently, the tubular member is positioned angularly with respect to the article, in order to reach a specific reciprocal position between a portion of the tubular member and the toe pocket of the article. This can be obtained by holding the article still and making the tubular member rotate therewithin; or vice versa.

The invention also relates to a device for handling tubular knitted articles, such as socks or the like, comprising: a tubular member; means to insert a tubular knitted article over the outside of said tubular member; tensioning members to tension said tubular article inserted over said tubular member; means for angular orientation of the article; a control unit to control the operations of said device. Characteristically, according to the invention the control unit is programmed to carry out, by means of said device, a method as defined above.

Further advantageous characteristics and embodiments of the device and of the method according to the invention are indicated in the appended claims and shall be described in greater detail hereunder with reference to some embodiments.

BRIEF DESCRIPTION OF THE DRAWINGS

The invention shall be better understood by following the description and accompanying drawing, which shows a non-limiting practical embodiment of the invention. More specifically, in the-drawing:

FIG. 1 shows a semi-finished article as it is unloaded from a circular machine;

FIGS. 2 to 8 show a positioning sequence, with reversing of the article on a tubular member;

DETAILED DESCRIPTION OF PREFERRED EMBODIMENTS OF THE INVENTION

Figure 3:
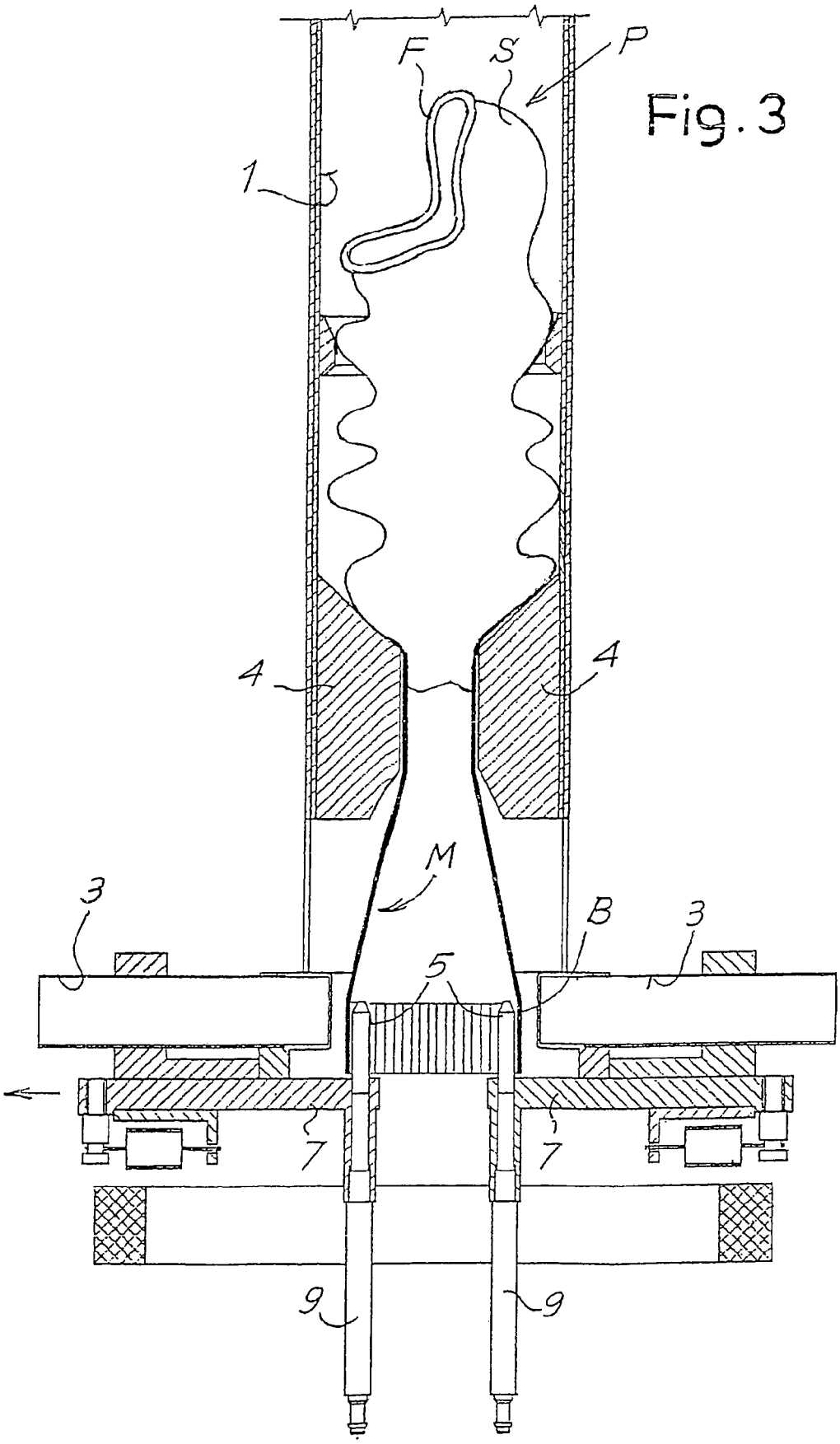

FIG. 1 schematically illustrates a semi-finished article as it is delivered from a circular machine, for example a double cylinder machine. The article is indicated as a whole with M. It has a foot and a leg portion indicated respectively with M1 and M2. The reference B indicates the elastic edge of the article, T indicates the heel pocket and P indicates the toe of the article which is delivered open from the circular machine and must be closed by sewing or linking. Produced along the edge of the open end P is a band F, constituted by a series of rows of stitches, optionally produced with a thicker yarn than the yarn forming the remaining part of the article. The object of this band, already known to those skilled in the art, is to allow handling during sewing and it is eliminated after the toe P has been closed by sewing or linking. The band F has a different color to the adjacent area of the article M. Provide adjacent to the end opening destined to form the toe is a second pocket of fabric, indicated with S and also called toe pocket.

The two pockets T and S are used to shape the garment and to improved fit. In some cases the article can be devoid of the pocket of fabric T of the heel. The toe must be closed with a sewing or linking line oriented orthogonally to the plane in FIG. 1, that is, orthogonally to the centerline or symmetry plane of the pocket S and/or of the pocket T.

The article M is delivered from the circular machine with the right side out, that is, the surface on the outside is the one that will effectively be the outer surface of the article when it is worn. Sewing of the toe must instead be performed by turning the article inside out so that the outer surface is the one that is normally on the inside.

For this purpose, a reversing operation is performed on a tubular member, said operation being known and represented in brief in the sequence in the successive FIGS. 2 to 8. The means used to perform this operation can vary and the means represented is only one of the possible configurations of these means. They are described in greater detail in WO-A-03018891, which should be referred to for a more accurate description. Equivalent means for this purpose are described in WO-A-02070801.

Briefly, the article M is inserted by suction in a tubular member 1 provided vided on the inside with profiles 4, the purpose of which is to deliver the article M to the members below, described briefly hereunder, in the most suitable position. The article M is inserted in the tubular member 1 with its elastic edge B oriented towards the opening 1A of the tubular-member 1. The article can arrive directly from a suction pipe connected to a knitting machine or to a plurality of knitting machines, or can be picked up from a suitable container, into which the articles coming from cone or more machines are introduced in bulk.

When the elastic edge B of the article M projects from the opening 1A of the tubular member 1 (FIG. 2), gripping suction members 3 (disposed for example in a number of four equidistant from one another about the axis of the tubular member 1), with a sequence described in the aforesaid WO-A-03018891, enlarge the opening formed by the elastic edge B. Pins 5 carried on slides 7, movable radially so that they can retract from the axis of the tubular member 1, are inserted into the stretched opening. The pins 5 are controlled by piston-cylinder actuators 9 which control insertion inside the elastic edge B when this is in the stretched position through the effect of the pneumatic members 3.

Figure 4:
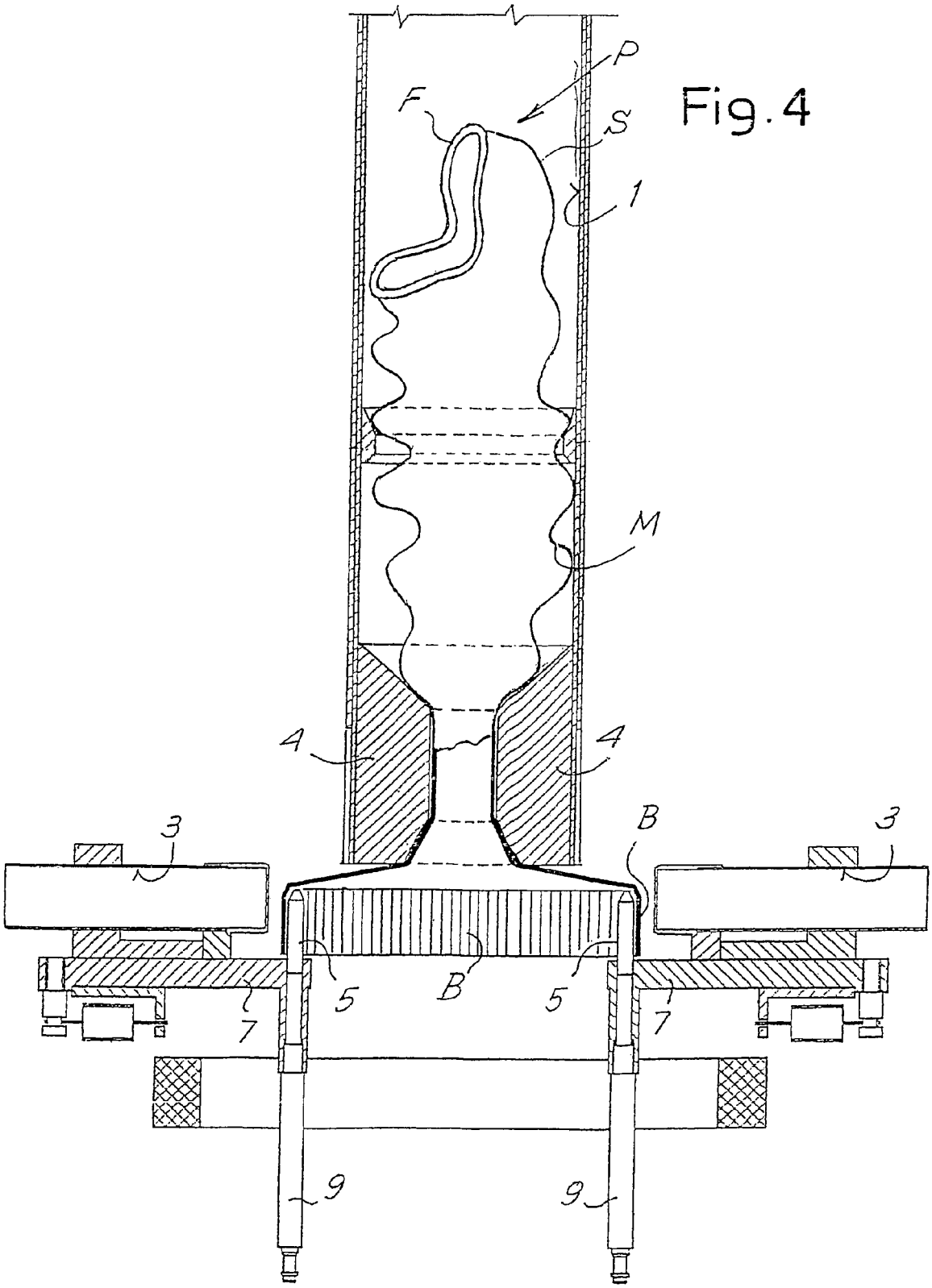
Figure 5:
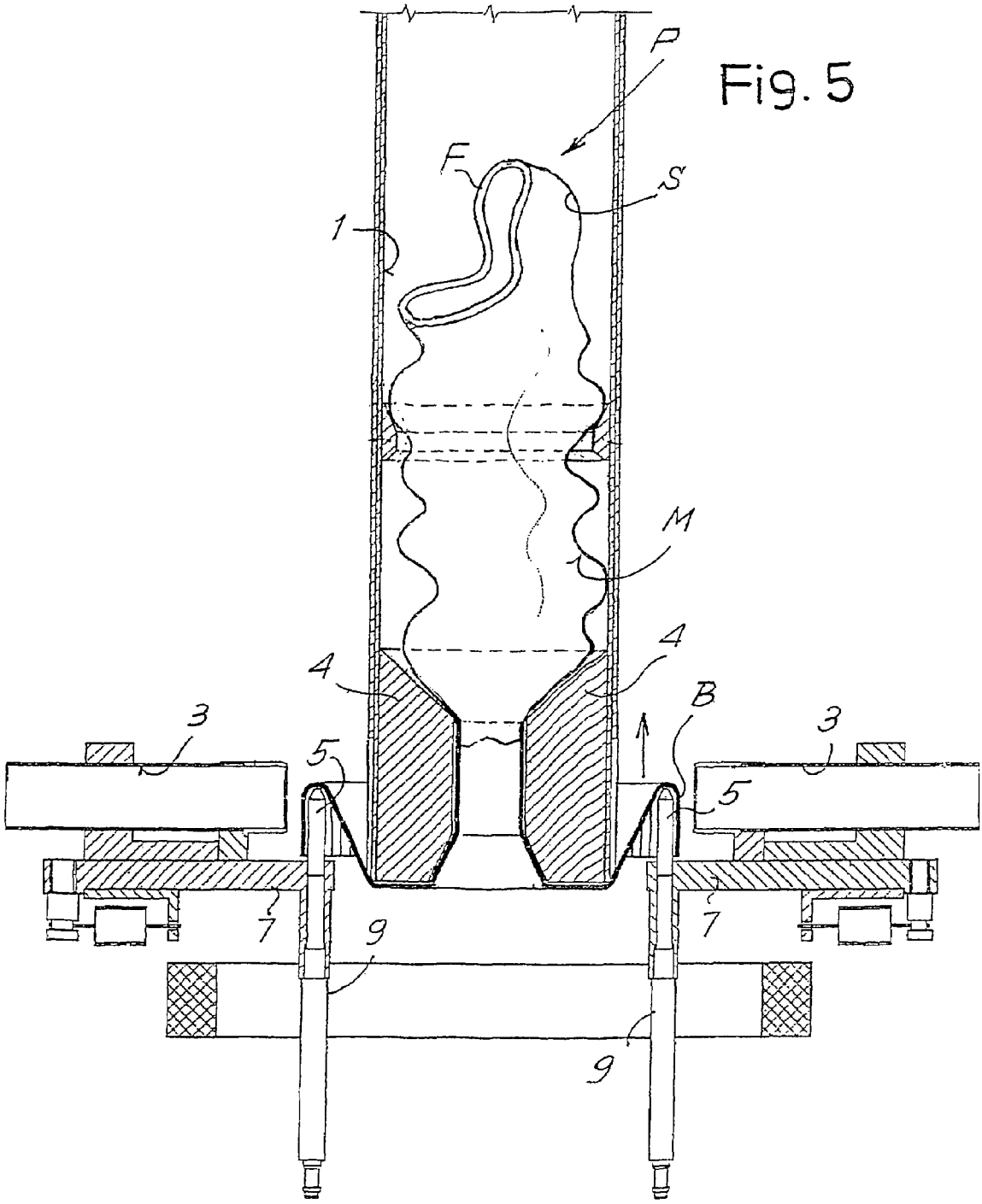
Figure 6:
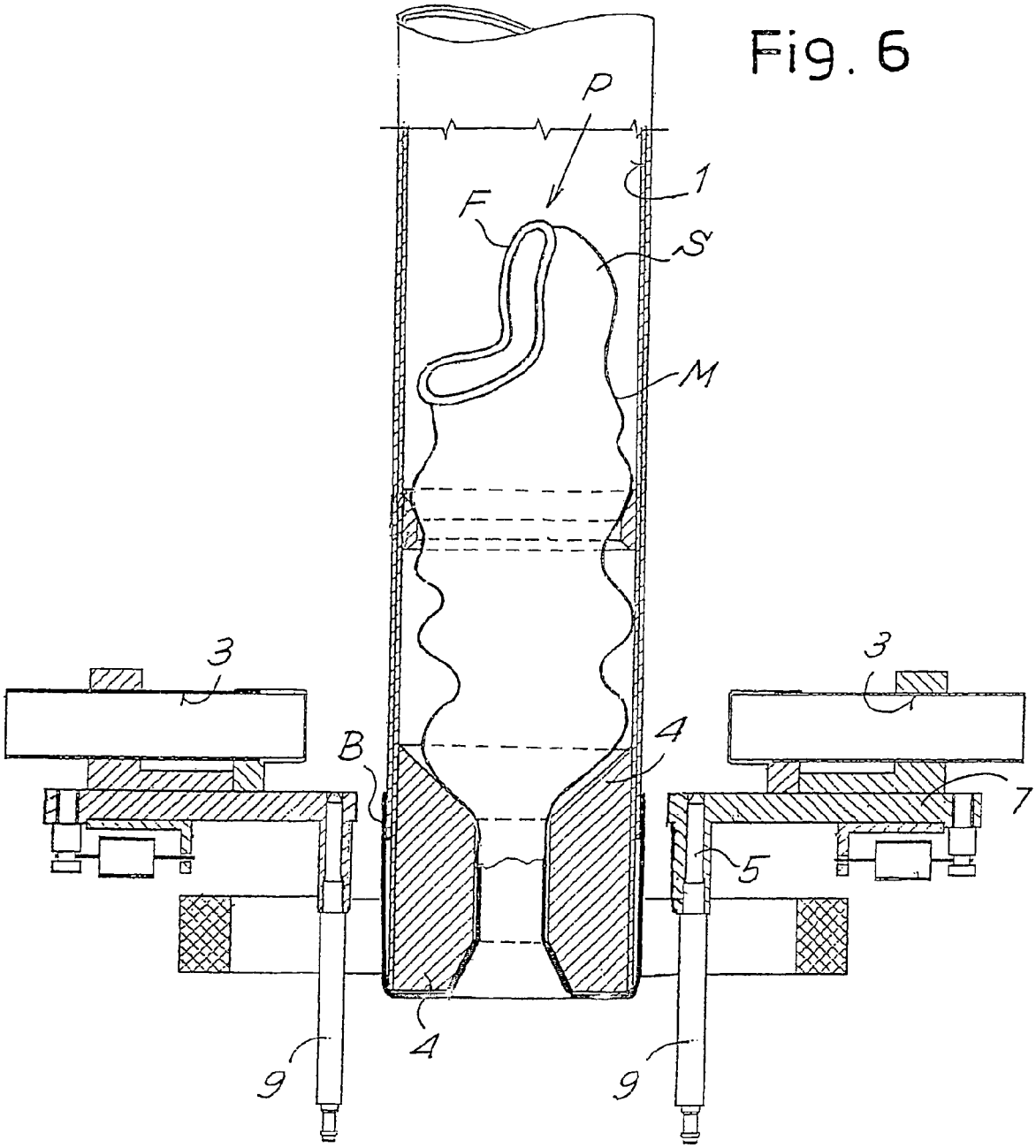

The slides 7 are moved radially outwards, drawing the pins 5, to stretch the elastic edge B of the article M to the position illustrated in FIG. 4, where the edge is outside the volume of the section of the tubular member 1. In this way (FIG. 5), with an axial movement of the slides 7 and of the pins 5 carried thereby, the article M can be reversed on the outside of the tubular member 1, to take the position shown in FIG. 6.

Figure 7:
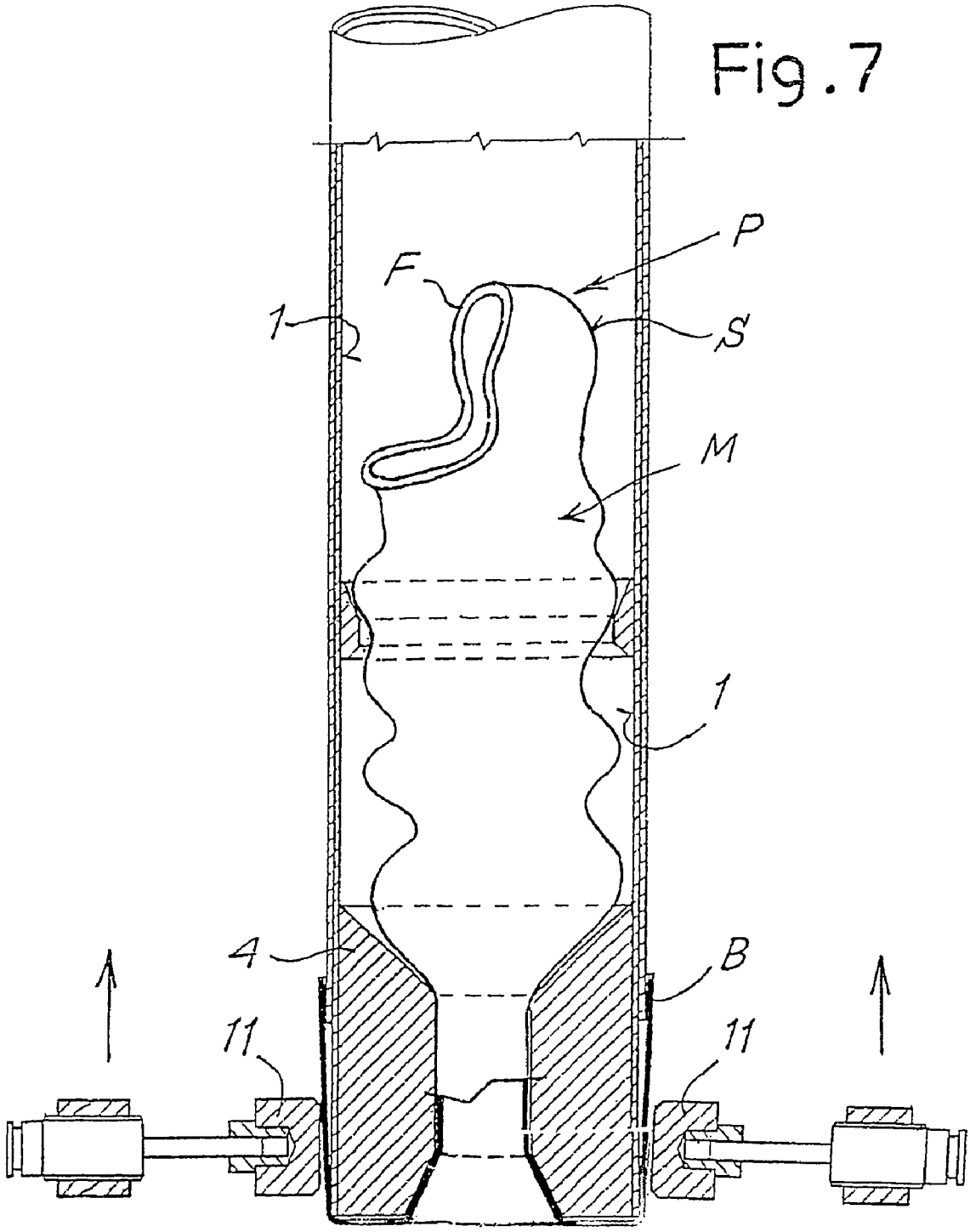
Figure 8:
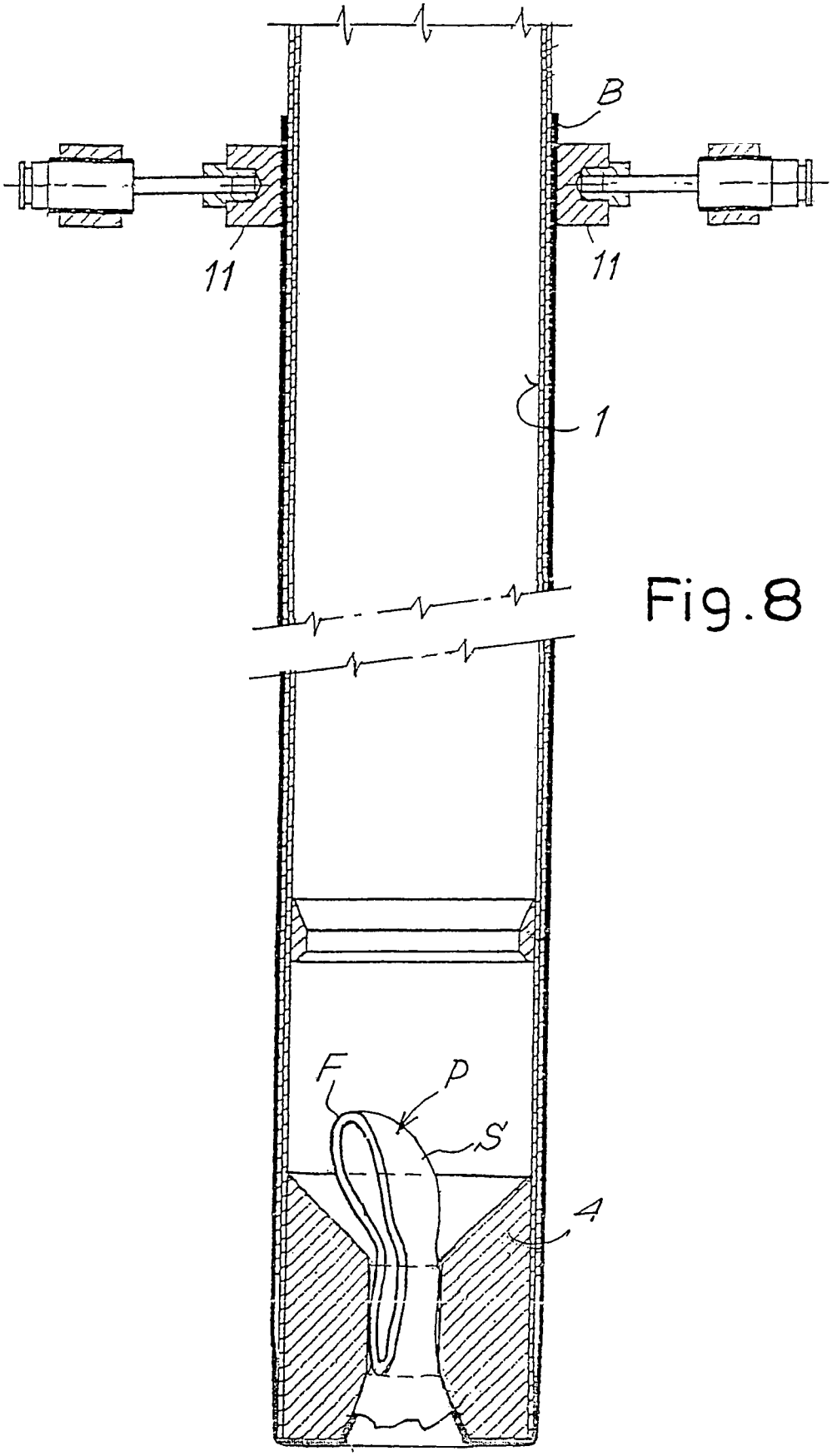
Figure 9:
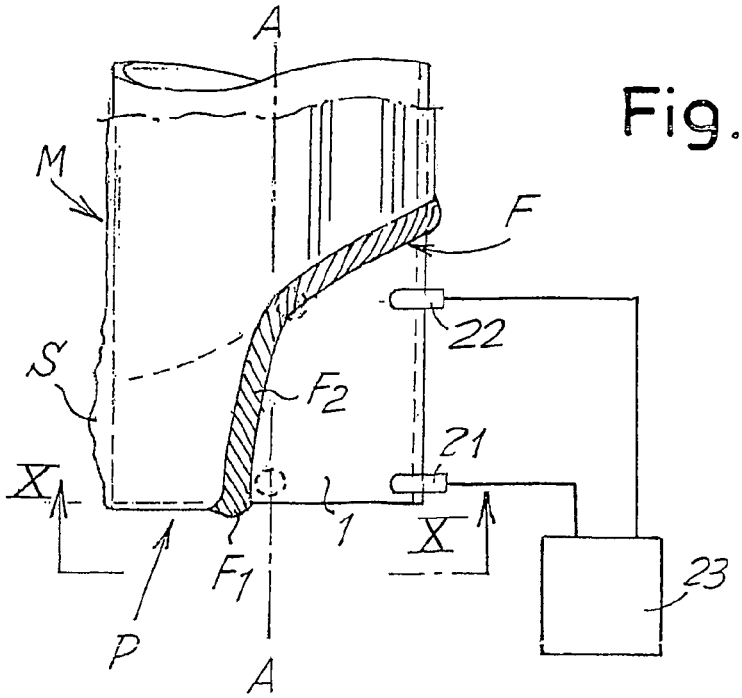
FIG. 9 schematically shows the layout of the article on the tubular member after reversing thereof.

A series of pads 11 movable along the axis of the tubular member 1, by moving alternatively along said axis and opening and closing with each stroke, reverse the article M from the inside to the outside of the tubular member 1 as shown in FIGS. 7 and 8, to take the toe P of the article to the position shown in particular in FIG. 9. In this position the pocket S of the toe of the article M is in a random angular position outside the tubular member 1 in proximity to the opening 1A thereof, while, through the effect of the tension imparted by the pads 11 on the tubular article M, the band F—produced in elastic yarn—is disposed as shown in FIGS. 9 and 10. In particular, it can be seen that through the effect of the elasticity of this band, of the traction in an axial direction and of the shape of the pocket S of the toe P, the band F is positioned with the intermediate area thereof (indicated with F1 in FIGS. 10A to 10D) along a chord of the circumference represented by the edge 1A of the opening of the tubular member 1, which preferably has a circular cross section. The remaining portion F2 of the band F is positioned outside the tubular member 1, as shown in FIGS. 9 to 10D.

The pocket S of the toe P is in the same angular position as the heel pocket T (if present), due to the way in which the article M was knitted. As mentioned previously, the seam to close the toe P must extend in a predetermined direction with respect to the toe pocket S and to the heel pocket T.

The method according to the invention allows the position of the pocket(s) S and T for correct orientation of the article to be sewn to be determined on the basis of the fact that the portion F1 of the band F is disposed in the position in FIGS. 9 and 10 on the tubular member 1, that is, along a chord of the closed line defined by the edge 1A When the article is correctly positioned, the angular position of the pockets S and T and of the portion F1 of the band F is identified by sensors, optical in this example, disposed adjacent to the end 1A of the tubular member 1, with a relative movement of rotation between the tubular member 1 and said sensors. In FIG. 9 the sensors are indicated with 21 and 22. They lie on the same plane containing the axis A of the tubular member. It is understood from the above and from the detailed description hereunder that in certain cases a single sensor 21 may be sufficient for the objects proposed by the invention.

Once the article M is disposed with the toe P thereof as illustrated in FIG. 9, the tubular member 1 is made to rotate about its own axis to sequentially take the positions illustrated in FIGS. 10A, 10B, 10C and 10D. It is understood that it is the relative movement between tubular member and sensors which is important and, therefore, that the sensors could rotate about the axis of the tubular member, although this solution is constructionally more complicated and consequently less advantageous.

Figure 10A:
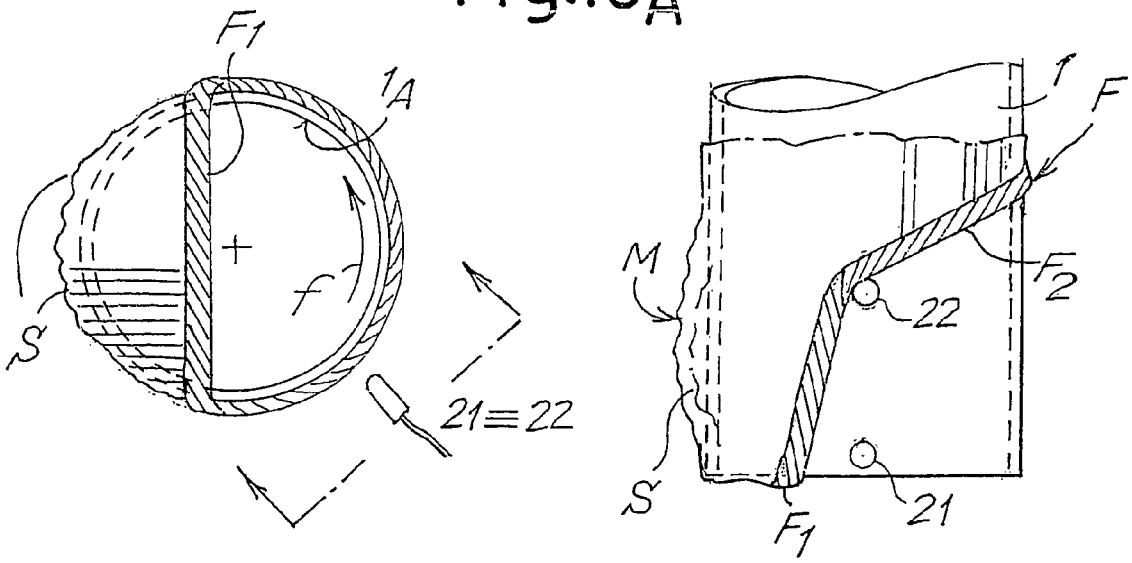
FIGS. 10A to 10D show sequences of the cycle to identify the angular position of the article on the tubular member, each figure showing the end part of the tubular member in a side view and in an end view according to a plane orthogonal to the axis.

In FIG. 10A the optical sensors 21 and 22 are both facing the tubular member 1 in an area devoid of fabric. By continuing to rotate the tubular member 1 according to the arrow f, first the sensor 22 and then the sensor 21 intercept the band F of the article, which surrounds the opening defined by the toe P.

As the band F is of a different color than the part of fabric of the article M adjacent thereto (and also than the surface of the tubular member 1), first the sensor 22 and then the sensor 21 produce a signal indicating that the side portion F2 of the beam F is passing in front of them.

Figure 10B:
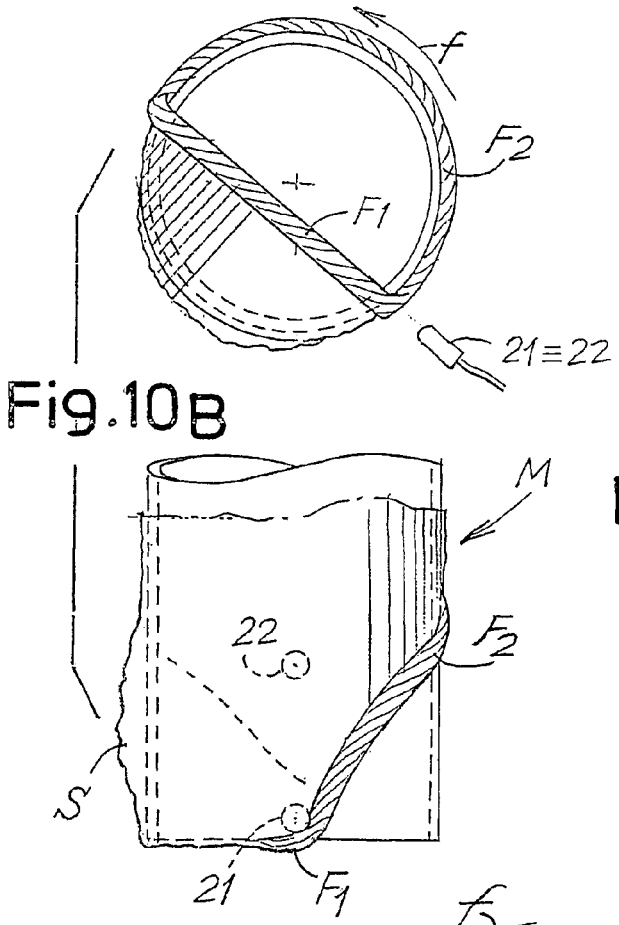
Figure 10C:
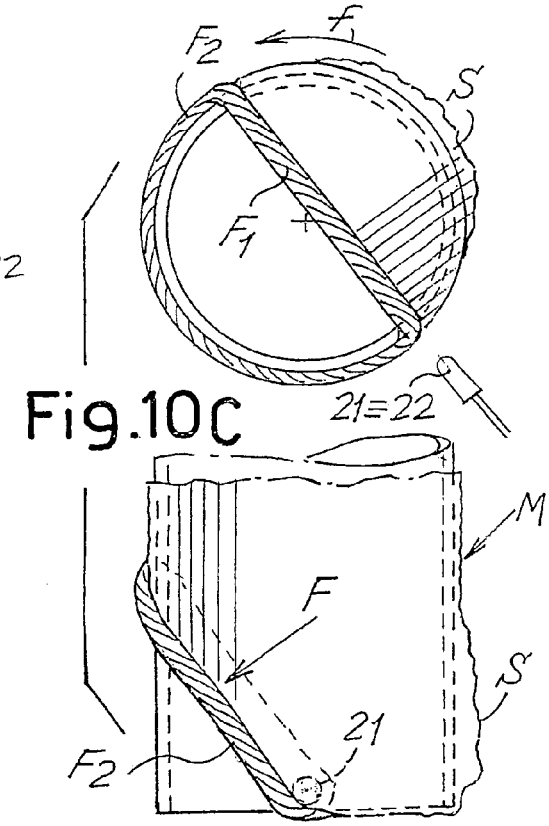
Figure 10D:
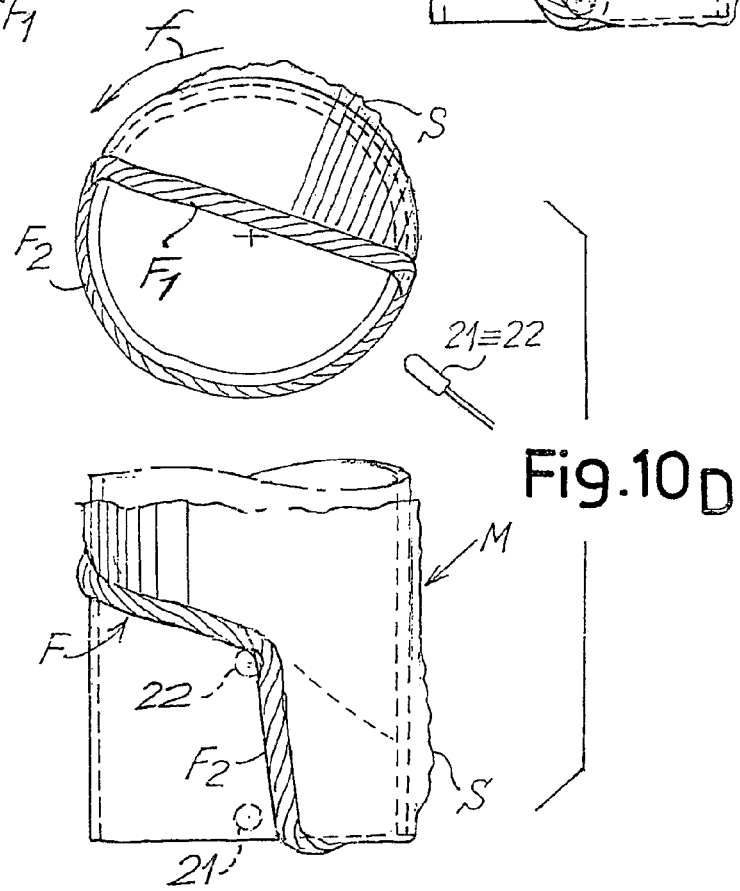

Continuing rotation according to the arrow f of the tubular member 1, said member with the article M stretched over the outside thereof passes through the position indicated in FIG. 10C. Here, first the sensor 21 and subsequently the sensor 22 intercept the portion F2 of the band F, opposed to the one intercepted in the phase illustrated in FIGS. 10A-10B, each producing a second signal.

In essence by performing a complete rotation through 360° of the tubular member 1 about the axis thereof A,-A, through the sensors 21 and 22 a central control unit 23 (illustrated schematically in FIG. 9) receives signals each time the portion of band F2 located on the side surface of the tubular member 1 passes in front of said sensors.

Thanks to the position taken by this band F on the tubular member 1, the signal produced by the sensor 21 will be anticipated or delayed with respect to the signal produced by the sensor 22 depending on whether passage from the area of the tubular member 1 devoid of fabric to the area covered by the fabric (passage between FIG. 10A and FIG. 10B) takes place or; vice versa, passage from an area covered by fabric to an uncovered area, that is, devoid of fabric (passage from FIG. 10C to FIG. 10D) of the surface of the tubular member 1.

In this way, even without the sensors 21 and 22 being able to distinguish between the surface of the fabric of the article M and the surface of the tubular member 1, it is possible to precisely identify the angular position of the pocket S of the toe P and correspondingly of the heel pocket T. In fact, this position will be in an exact medial position with respect to the angular positions at which the sensors 21 and 22 produce their signal. To distinguish between two positions, diametrically opposed and lying on the same plane, containing the axis A-A of the tubular member 1 and medial with respect to the angular positions which produce the signal of the sensor(s) 21 and 22, the aforesaid delay or anticipation of the signals emitted by the two sensors superimposed on each other along the axial direction of the tubular member 1 is used.

Figure 11:
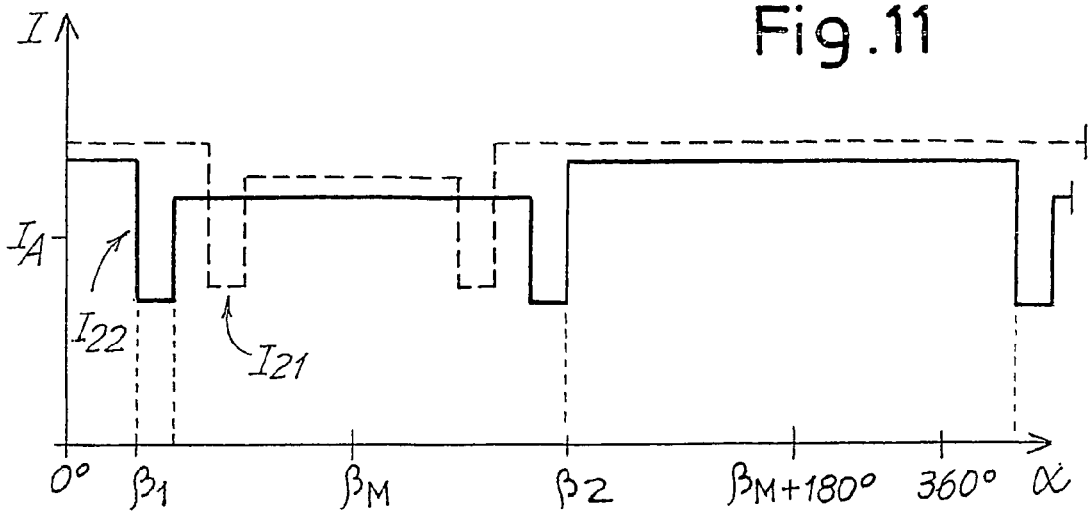
FIGS. 11 to 15 schematically show the signals produced by the sensors during the phase to identify the angular position of the pocket of fabric of the article inserted over the tubular member.

FIG. 11 schematically shows the trend of th e signal of the sensors 22 and 21, represented respectively by the curves $I_{22}$ and $I_{21}$. The abscissa indicates the angle of relative rotation between the tubular member 1 and the sensors, and the ordinate a generic unit of measurement of the intensity of the signal. The origin was placed at the position of zero, coinciding with the initial angular position. In the 0°-360° interval the signal $I_{22}$ and the signal $I_{21}$ have two areas in which they drop below a threshold value $I_A$. The intermediate position $\beta_M$ between the two angular positions $\beta_1$ and $\beta_2$ corresponds to the angular position of the plane containing the axis A-A of the tubular member and passing though the central area of the pockets S and/or T. In the example illustrated in FIG. 11 the first falling ramp is the ramp of the signal $I_{22}$. This means that the article M on the tubular member 1 is, with respect to the sensors 21 and 22, in a position in which in the instant rotation starts (point of origin of the abscissas) these sensors are both facing the free surface of the tubular member 1.

Figure 13:
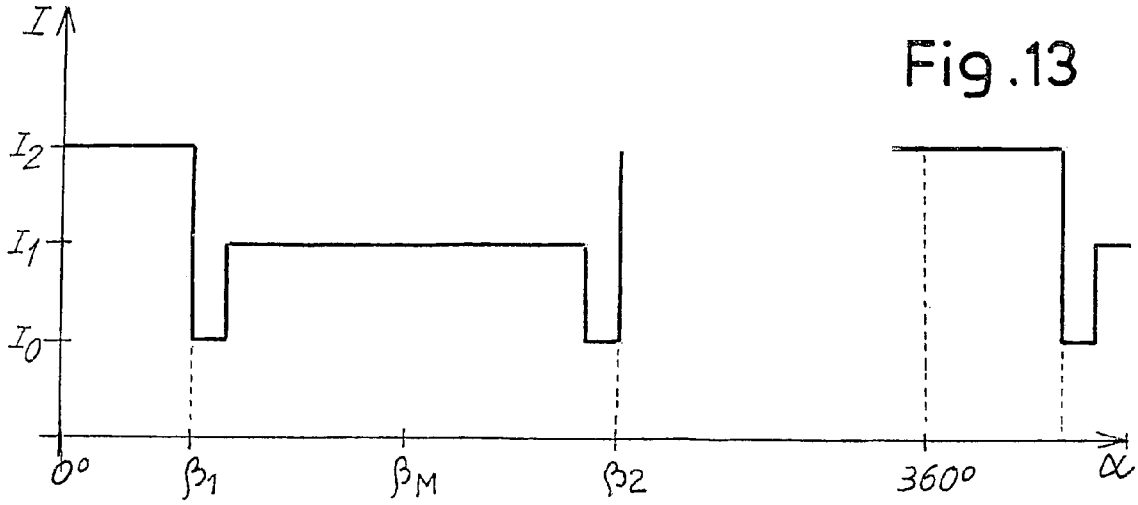

FIG. 13 shows a situation wherein the article M is on the tubular member in a position in which at the origin of rotation the sensors are facing the area covered by the fabric of the article. The medial position between the first pair of falling peaks of the signals $I_{21}$ and $I_{22}$ therefore is not the position searched for, but offset by 180° with respect to the position of the pocket S, again indicated with $\beta_M$.

Figure 12:
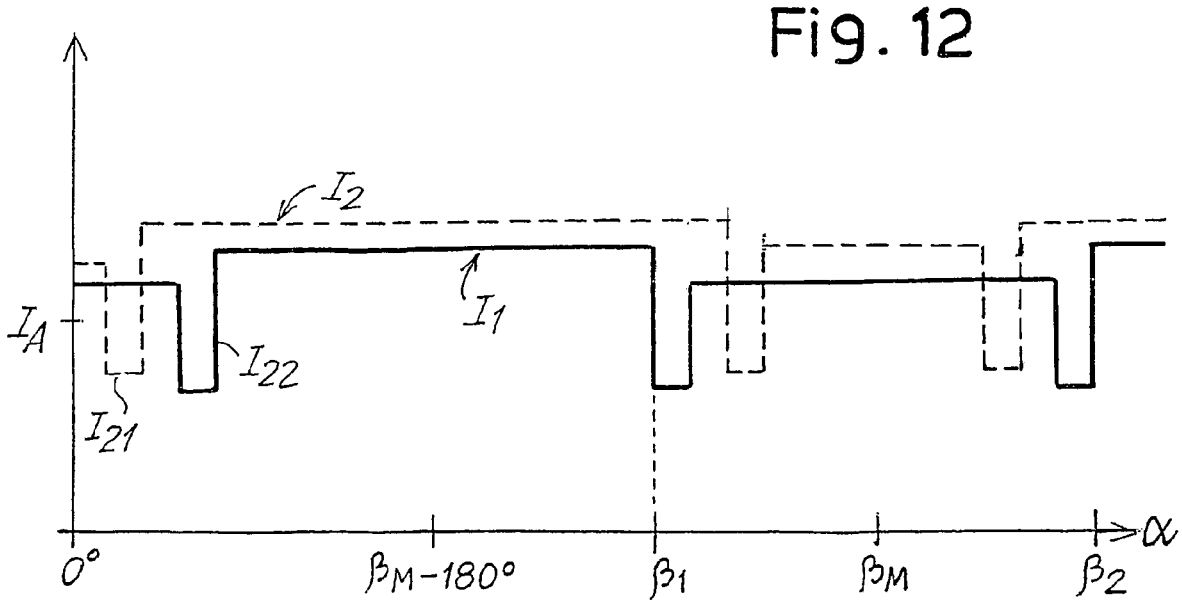

It is observed that in the case of FIG. 11, the first signal peak comes from the sensor 22, while in the case in FIG. 12 the first peak comes from the sensor 21. On the basis of this sequence the central unit is able to identify the angular position $\beta_M$ distinguishing it from the diametrically opposite angular position $\beta_M$+180° or $\beta_M$−180°.

In a modified embodiment, it is possible to detect, with a single sensor 21 or also with two sensors 21, 22 (optionally different from each other) disposed approximately in the same position, the instant of passage of the edge of the fabric (and therefore the angular position corresponding to this instant) during reciprocal rotation between the sensor and the tubular member 1 about the axis A-A. For example, this can be obtained by providing a tubular member 1 with a reflecting outer surface and a sensor with a transmitter and a receiver. When an area of the tubular member covered by the fabric of the article M passes in front of the sensor, the receiver of the sensor produces a different signal (in particular lower) to the one it produces if the free area of the surface of the tubular member passes in front of it. The rising and falling fronts of the signal determine the angular positions of the edge of the toe and consequently the medial position in which the pocket of fabric S or T is positioned. FIG. 13 schematically shows the diagram of the signal produced by a sensor of this type. The angle and a unit of measurement of the signal are again indicated respectively on the abscissa and ordinate. The curve represents the signal produced in a rotation through 360°. Three thresholds with the values $I_2$, $I_0$, $I_1$ of the signal are identifiable, respectively indicative of the area of signal reflected by the surface of the tubular member, of the area of transit of the band F (hypothetically darker) and of the area of transit of the fabric. The angular position of the pocket S is indicated with $\beta_M$, an intermediate value between the values $\beta_1$ e $\beta_2$. If the article has no band F of a different color with respect to the surrounding fabric, the signal produced by the sensor will be of the type represented in FIG. 14, which again allows identification of the mean position $\beta_M$.

Figure 14:
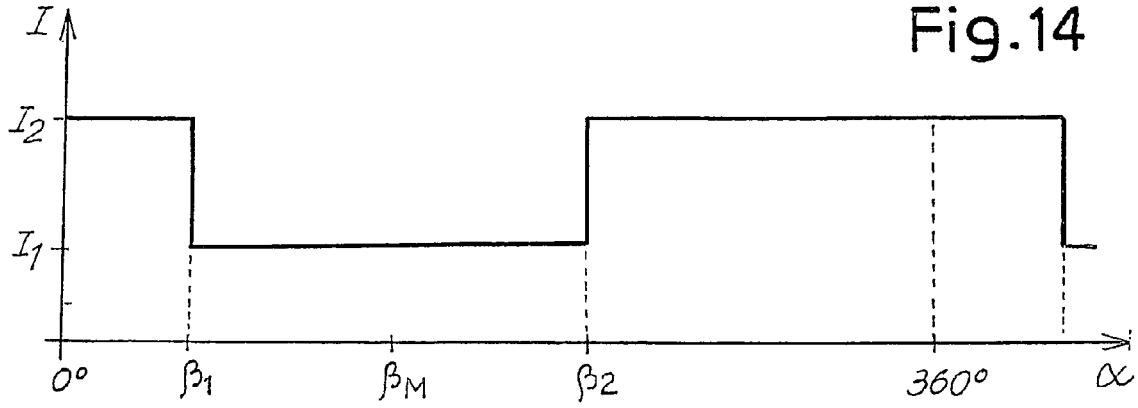
Figure 15:
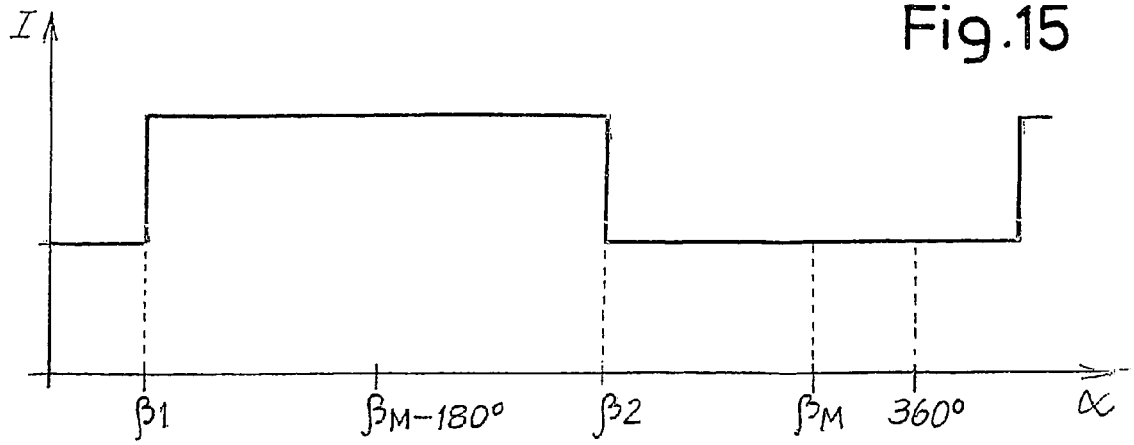

Both in FIG. 13 and in FIG. 14, the initial position of the article on the tubular member 1 is such that the sensor faces the area of the tubular member 1 which is free, that is, not covered by the fabric of the article. Instead, FIG. 15 shows the signal of the sensor (analogous to the signal in FIG. 14), in the case in which the initial position of the article is such that the sensor faces the surface of the fabric instead of the free surface of the tubular member. In the case in FIG. 14, the position OM is the one identified between the first and second ramp (respectively falling and rising) of the signal. In the second case, as the first ramp is rising and the second falling, the intermediate position between the angular positions in which these ramps are located is the one offset by 180° with respect to the angular position $\beta_M$ of the pocket.

Described above is a device that uses a pair of optical sensors. Nonetheless, it would also be possible to use another type of sensor, for example capacitive or magnetic. In this case the band surrounding the opening of the article destined to be closed to form the toe can contain a yarn detectable by these types of sensor.

Figure 16:
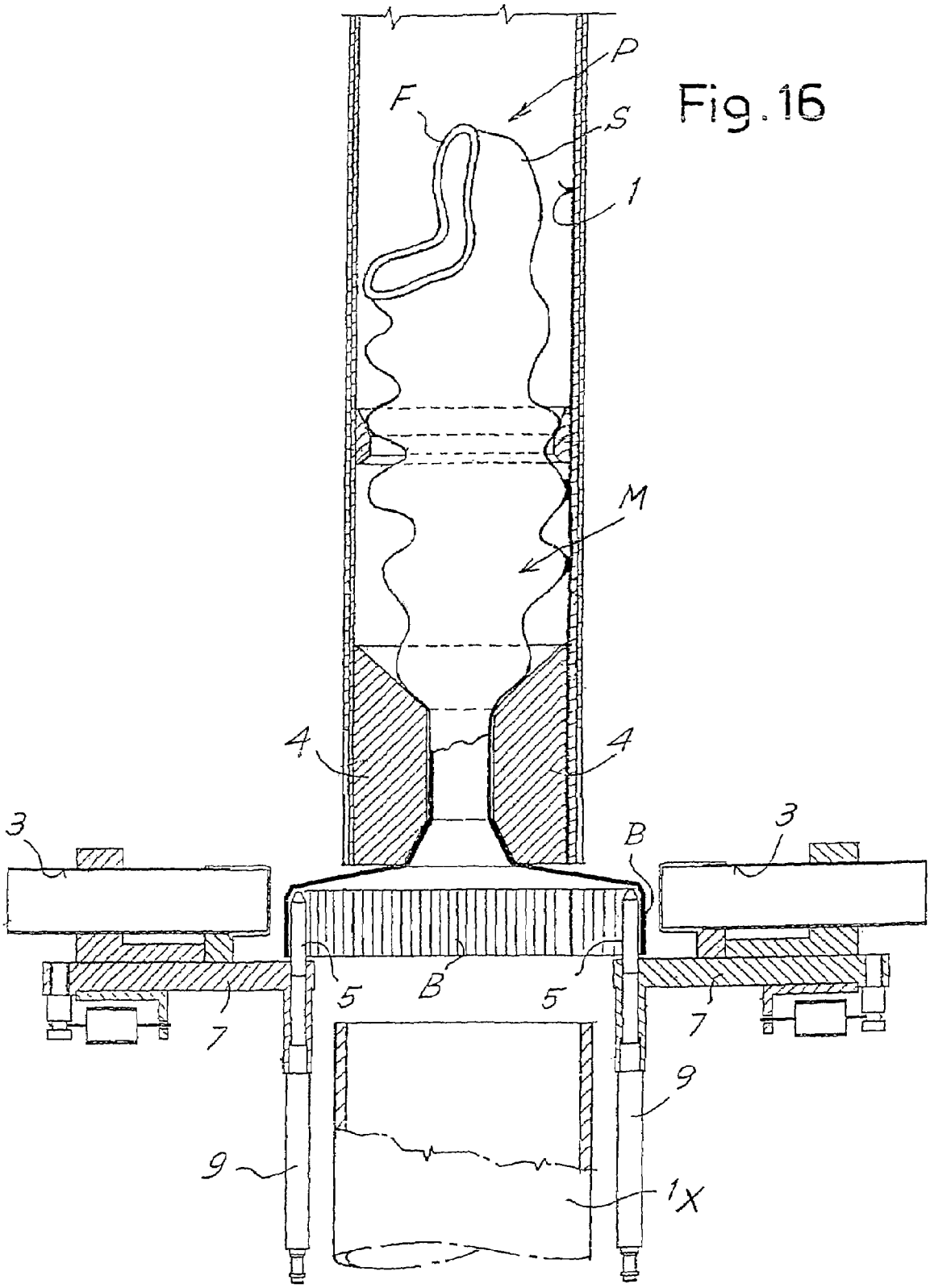
FIG. 16 shows a modified embodiment, suitable for handling socks delivered from double cylinder machines.

In the above, and specifically in the description of FIGS. 2 to 8, reference was made to a mechanism to reverse the sock or other article to be oriented. In some cases, nonetheless, reversing of the article is not necessary, as it is already reversed when delivered from the production machine. This occurs, in particular, in the case of double cylinder knitting machines. The article must not be reversed on the outside of the tube 1 from which it is fed. FIG. 16 shows the solution that can be adopted in this case: the article M is engaged by pins 5 which, instead of reversing the edge B onto the outside of the tube 1, transfers it to the outside of a secondary tube 1X, positioned coaxially to and in front of the tube 1. Using a system of pads analogous to the p ads 11, or another suitable system, the article M is inserted over the tube 1X until the band F is stretched, as in the previous case, on the end of said tube. Apart from that, the system operates analogously to the description above, using the tubular member 1X instead of the tubular member 1. In this configuration, the sensors will naturally be associated with the tubular member 1X.

In one or other configuration, the handling mechanisms of the article M may differ from those illustrated by way of example. For example, the pistons 11 may be replaced by small wheels or belts. Moreover, the pins 5 may be carried by an assembly mechanically disconnected from the gripping suction members 3. These members 3 may be replaced by mechanical means for engaging the article.

The number of pins 5 and members 3 may vary, from a minimum of three or preferably four. Advantageously, six elements may be used disposed around the axis of the tube 1.

Figure 17:
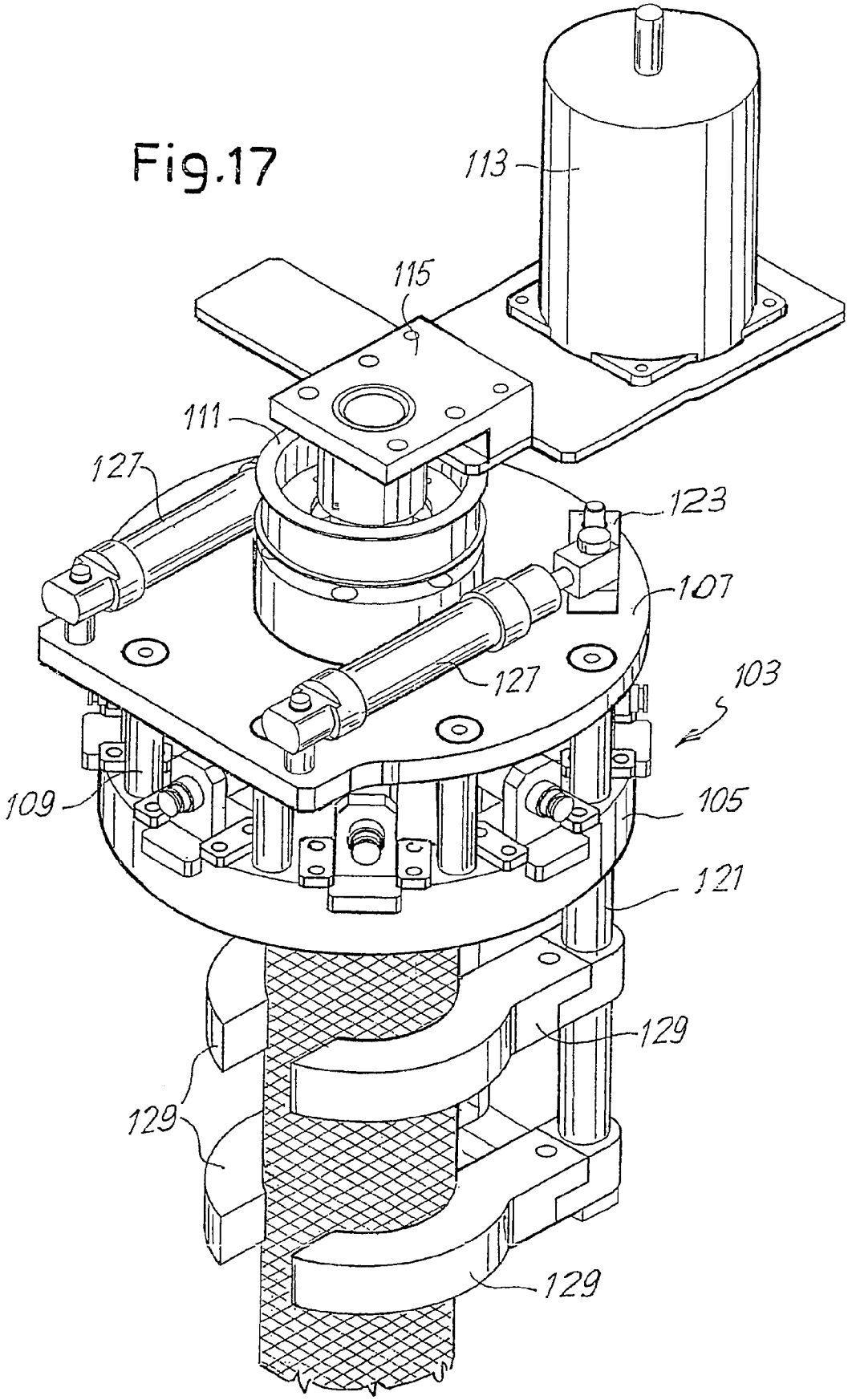
FIG. 17 shows an axonometric view of a device according to the invention in a different embodiment.

FIGS. 17 and 19 show;a different embodiment of the device and of the method according to the invention. In these figures the devices to position the tubular knitted article M over the tubular member are omitted, and may be essentially identical to those described above, although the device in FIGS. 17 to 19 is reversed, that is, disposed with the end of the tubular member over which the tubular-knitted article M is inserted facing upwards instead of downwards.

The tubular member is indicated with 101. Disposed around the upper end thereof is a support indicated as a whole with 103, positioned coaxially to the tubular member 101. The support 103 has a ring 105 connected by columns 109 to a plate 107 arranged above said ring. The plate 107 is connected to a pulley 111 driven about which is a belt, not shown for clarity of the drawing, to transmit to the pulley 111, to the plate 107 and, consequently, to the entire support 103 a rotational movement imparted by an electric motor 113. The motor 113 is supported through a bracket 115 by a fixed structure, not shown.

Figure 18:
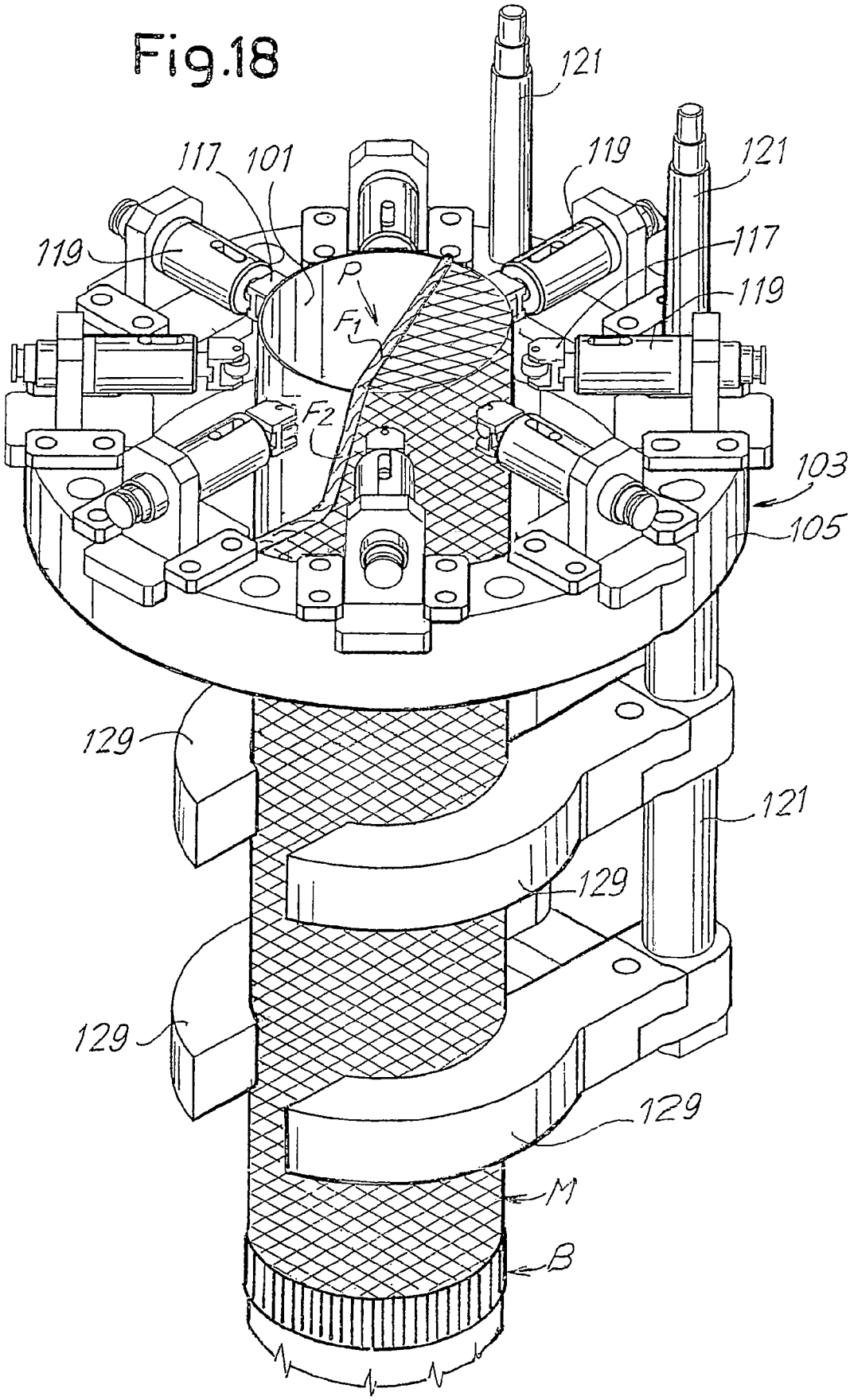
FIG. 18 shows the device in FIG. 17 with parts removed.

In FIG. 18 the plate 107 with the columns 109 has been removed to show a plurality of electrical contacts 117 disposed according to a circular ring around the top end of the tubular member 101. Each electrical contact 117 is produced—in this example of embodiment—in the form of a small wheel. Each of these wheels can be taken to an active position, in contact with the tubular member 101 or with the article M inserted thereover, or to an idle position, in which it is not in contact with the tubular member 101 or with the article M. The radial movement of the contacts 117 is controlled by piston-cylinder actuators 119.

The ring 105 carries two rods 121 extending downwards parallel to the axis of the tubular member 101, each of which is connected, at the top end thereof (projecting above the plate 107) to a lever 123 (FIG. 17) to which the rod of a respective piston-cylinder 127 is hinged. The cylinder of the piston-cylinder actuators 127 is hinged to the plate 107 to allow an oscillatory movement of said cylinders when the actuators extend and retract. The piston-cylinder actuators 127 thus control an oscillatory movement of the rods 121 about the axes thereof.

Keyed onto the rods 121 are arcuate jaws 129, which with the oscillatory movement of the rods 121 enclose the tubular article M around the tubular member 101 or withdraw therefrom. By closing the jaws 129 around the tubular knitted article M and rotating the support 103 about the axis of the tubular member 101, which remains fixed in space, the tubular knitted article M is made to slide on the outer surface of the tubular member 101, to position the article M angularly with respect to the tubular member 101 to perform the subsequent operations on the article.

Operation of the device described hereinbefore will be illustrated here-under with specific reference to the sequence in FIGS. 19A-19E, which represent, in a schematic view orthogonal to the axis of the tubular member 101, the operating sequence to determine the angular position of the article M with respect to the tubular member 101.

Represented in FIGS. 19A-19E are: the tubular member 101 with the axis A-A thereof; the article M inserted over the tubular member 101 with the band F disposed with the intermediate portion F1 thereof along a chord of the circumference represented by the top edge of the tubular member 101 and with the side portions F1 disposed along the side surface of the tubular member 101. Also shown is the series of electrical contacts 117 constituting the sensors to determine the angular position of the tubular knitted article M. The various electrical contacts are indicated with 117A-117H. The object of the sequence of phases shown in FIGS. 19A-19E is to determine the angular position of the article M. In the sequence represented herein, the electrical contacts 117A-117H are shown fixed and the tubular member 101 rotating about its axis, but it is understood that the movement between the tubular member 101 and the electrical contacts is a relative angular movement and that, therefore, the tubular member 101 could be fixed and the electrical contacts 117A-117H could rotate about the axis A-A as is, in fact, the case in the mechanical solution shown in detail in FIGS. 17 and 18.

Figure 19A:
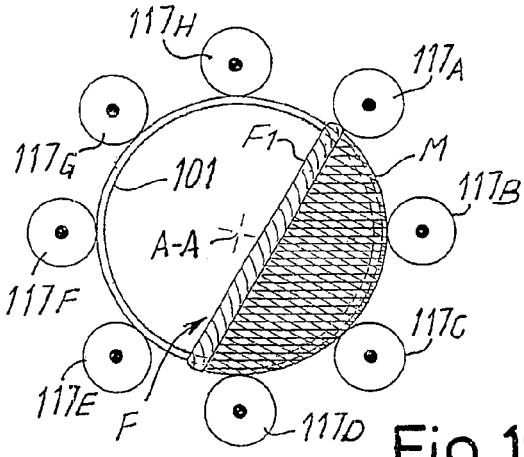
FIGS. 19A-19E schematically show an operating sequence of the device in FIGS. 17 and 18.

In a first phase (FIG. 19A), all the contacts 117A-117H are active, that is, they are taken to abut against-the tubular member 101. The various electrical contacts 117 form part of an electrical circuit controlled by a programmable control unit analogous to the unit schematically indicated with 23 in the previous embodiment. As can be seen in FIG. 19A, the electric contacts 117E-117H touch the tubular member 101, produced entirely or in part in an electrically conducting material, while the contacts 117B-117D are isolated with respect to the tubular member 101 due to interposing of the fabric forming the article M. As a result, the electrical contacts 117E-117H are closed, while the electrical contacts 117A-117D are open.

The control unit is able to detect that the band F of the tubular knitted article M is positioned between the contacts 117A and 117H and between the contacts 117D and 117E. The contacts 117A and 117D are the contacts closest to the band F (or rather to the side portions F2 of the band F) and which are located on the fabric of the article M. These two contacts will be used in the subsequent phases.

Figure 19B:
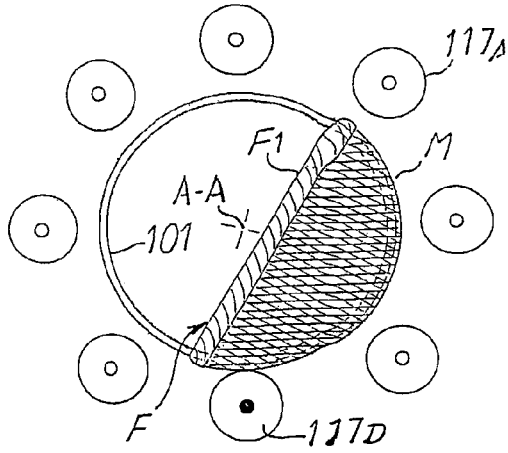
Figure 19C:
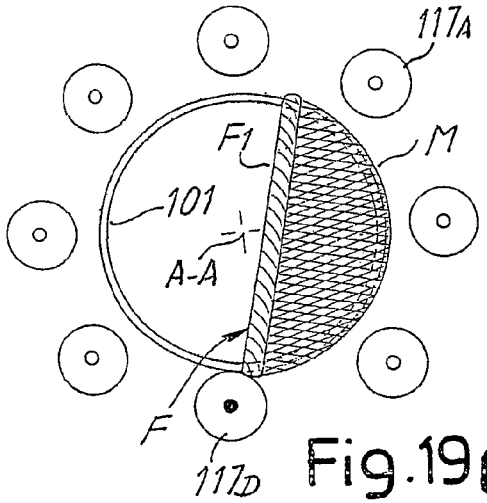
Figure 19D:
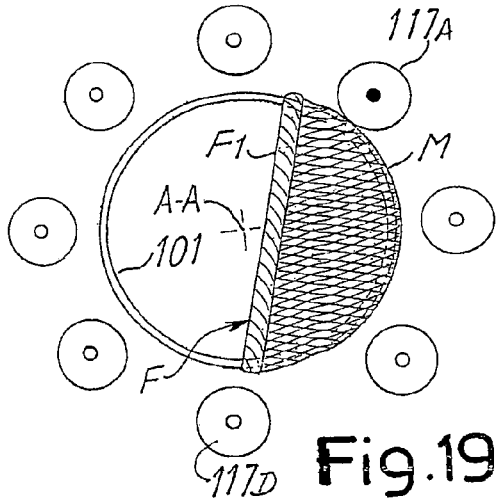

FIG. 19B shows that all the electrical contacts have been withdrawn from the axis of the tubular member 101 with the exception of the contact 117D. At this point, the control unit causes a relative angular movement between the tubular member 101 and the article M on the one hand and the ring of electrical contacts 117A-117H on the other, in practice said movement being obtained, in the constructional solution in FIGS. 17 and 18, by rotating the support 103 by means of the motor 113, but which in FIG. 19 is shown as a rotation of the tubular member 101. Relative rotation is interrupted when the circuit in which the electrical contact 117D is inserted is closed, which takes place in the position in FIG. 19C, when this contact surpasses the position of the band F and comes into contact with the tubular member 101. By knowing the initial angular position and detecting (using an angular encoder mounted on the moving part, that is, the support 103 in FIGS. 17, 18) the angular movement carried out from the initial position to the one in FIG. 19C, the central control unit 23 is able to identify the position of one of the two side portions F2 of the band F.

The position of the second portion F2 of the band F is obtained with the successive steps of the sequence represented in FIG. 19. The electrical contact 117D is withdrawn from the tubular member and loses contact therewith, while the contact 117A is activated and taken to abut against the fabric of the article M (FIG. 19D). At this point a relative angular movement is carried out between the tubular member 101 and the ring of contacts 117 in the direction opposite to the previous movement. This movement may also commence before the contact 117A is taken into contact with the fabric of the article M, providing the movement is detected by an encoder or other equivalent system and that it does not take the contact 117A in front of the portion of tubular member 101 devoid of fabric before the contact 117A has been taken to its active position.

Figure 19E:
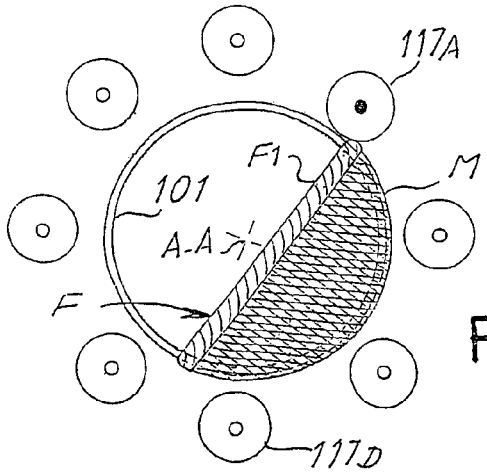

The angular movement continues at least to the position in FIG. 19E, where the contact 117A closes the respective electric circuit, entering into electric contact with the tubular member 101. The central unit receives the respective signal which indicates thereto that it is the angular position in which the second side portion F2 of the band F is located.

At this point the central control unit 23 knows the angular positions of the two side portions F2 of the band F and (through the data acquired in the first step, FIG. 19A) is also capable of knowing on which of the two complementary arcs defined by the two aforesaid angular positions the heel pocket is located (that is, the arc on which the contacts 117A-117D are located). The intermediate point of this arc identifies the position of the heel pocket.

The position of the heel pocket and therefore of the toe pocket is thus determined and the article M can be gripped to be sent for sewing. In order for the article to be presented in the correct angular position for sewing, which normally does not coincide with the entirely random position detected with the aforesaid procedure, the subsequent operation consists in closing the jaws 129 using the actuators 127 and reciprocal rotation of the tubular member 101 and the support 103. During this rotation the tubular article M remains integral with the jaws 129 and therefore with the support 103. Reciprocal rotation is of a degree that takes the heel pocket and the toe pocket of the article, with respect to the tubular member 101, to the correct angular position to carry out subsequent sewing.

In the case in which the tubular member 101 rotates about the axis thereof and the support 103 is fixed with respect to the axis A-A, positioning of the tubular article M may take place simply by rotating the tubular member 101 about the axis thereof before the subsequent operation to pick up the article M from said tubular member.

In a modified embodiment, angular positioning of the tubular article M may take place by rotating the tubular member by an angle determined on the basis of detection performed by the sensors, optionally in a subsequent station, to which the tubular member is transferred. In this case, the jaws 129 and relative actuation means are omitted.

In a possible variant of embodiment, instead of optical reflection sensors as described with reference to FIGS. 9 to 12, or electrical sensors as described with reference to FIG. 17 to 19, distance sensors, for example of the optical type, such as background suppression sensors, could be used. Rather than being based on reflection of the light beam, which could be reduced by dulling of the tubular member 1 or 101, these sensors are based on measurement of the distance of the surface located in front of the sensor. This distance is lesser at the level of the fabric of the tubular article M and greater where this fabric is absent. The orientation principle remains unchanged.

FIGS. 20 to 27 show a further embodiment of the device and of the method according to the invention. In this embodiment the device has at least two stations in which different operations are performed.

Figure 20:
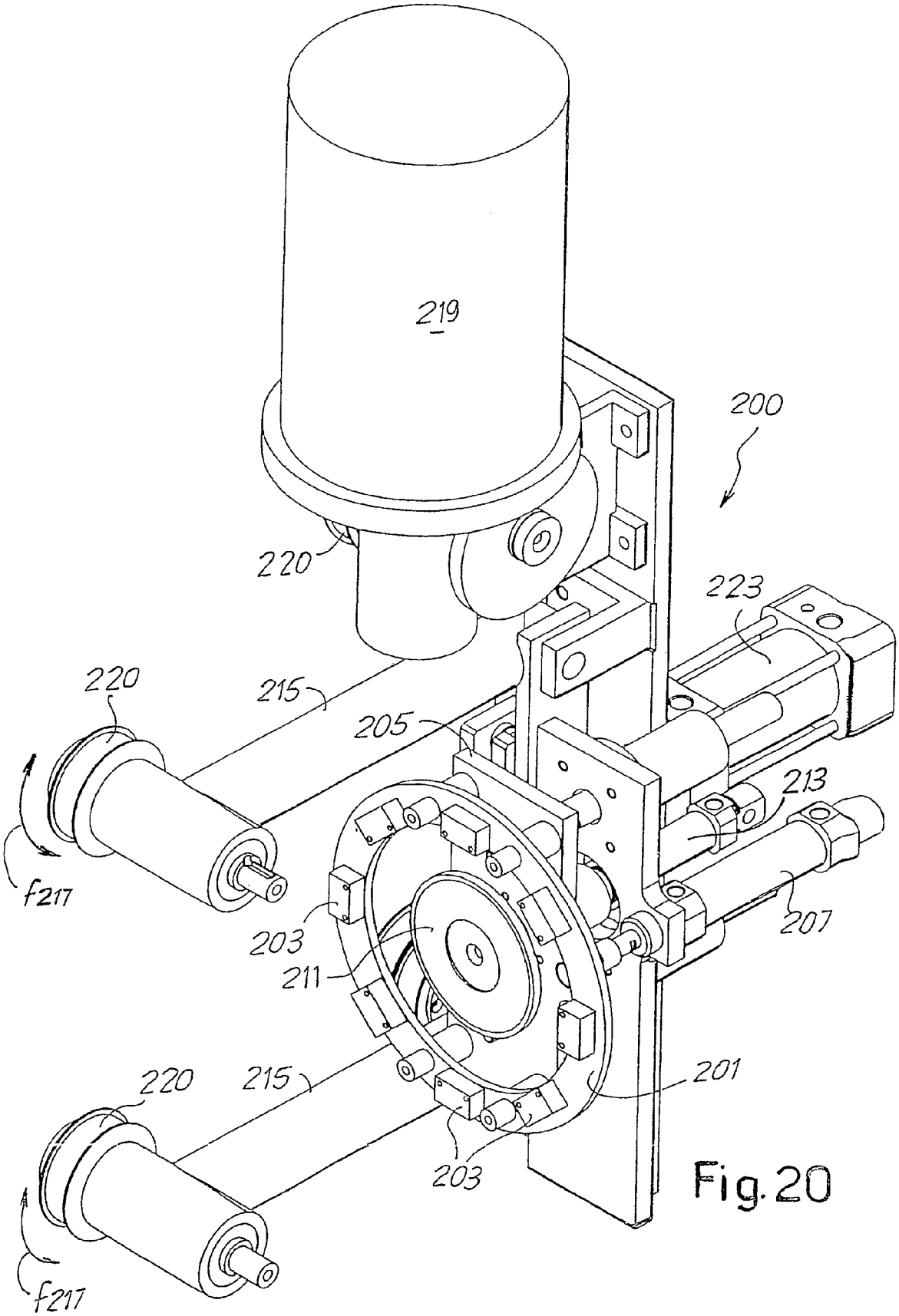
FIGS. 20 to 27 schematically show a further embodiment and relative operating sequence.
Figure 21:
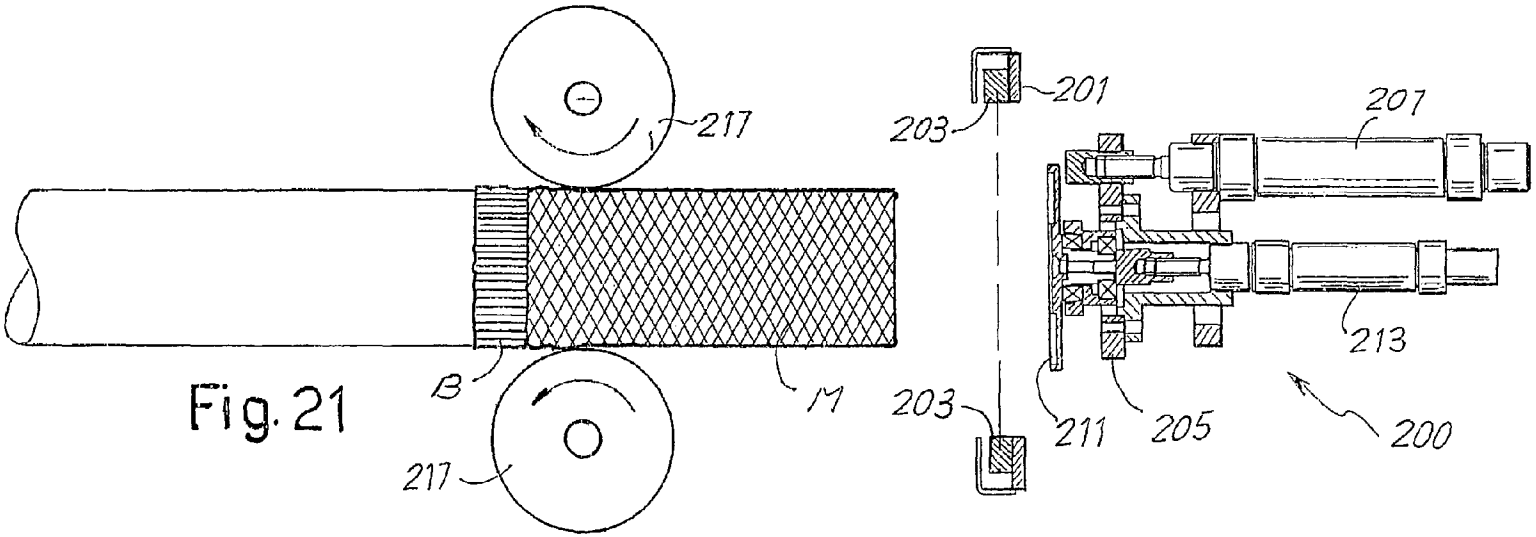
Figure 22:
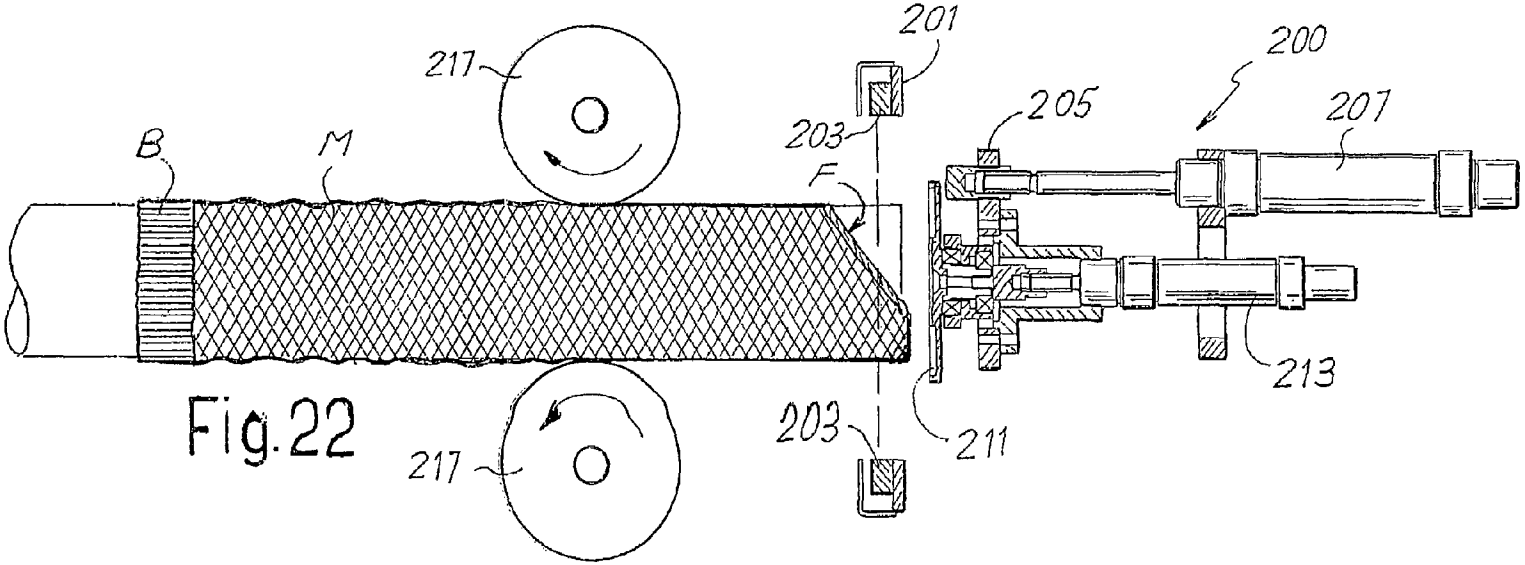
Figure 23:
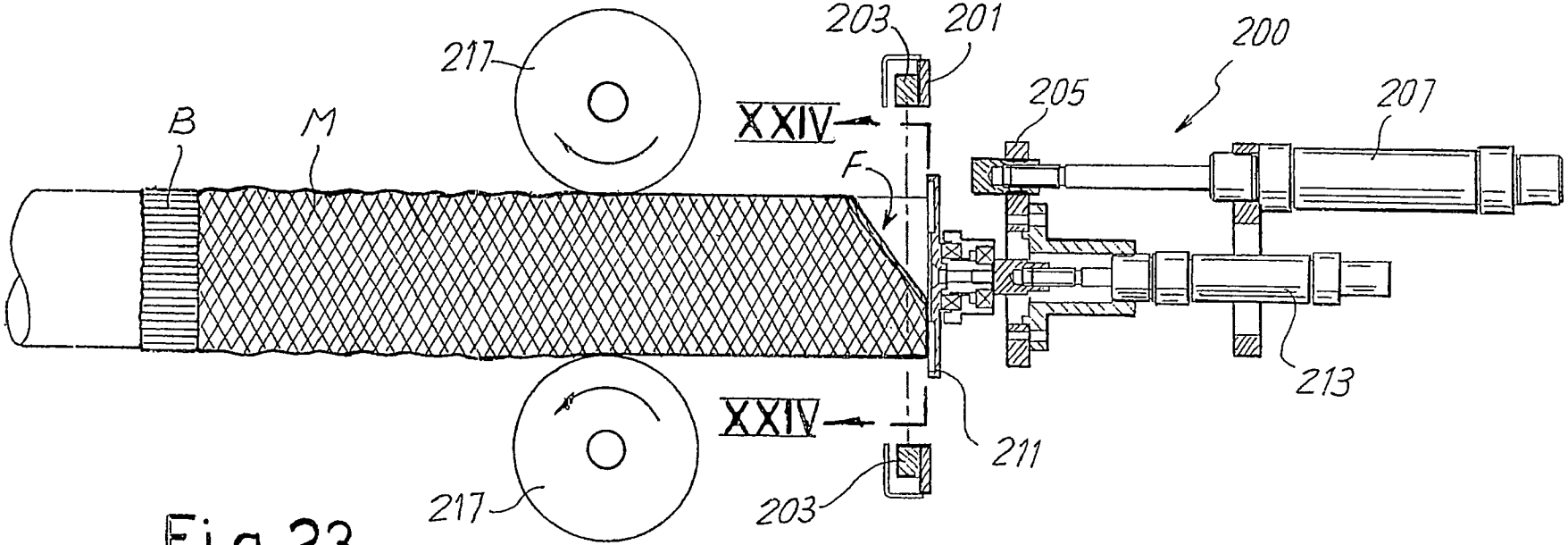

FIGS. 20 to 23 show in an axonometric view and a longitudinal section a first station of the device. In greater detail, FIG. 20 shows the head of the first station, with parts removed, while the remaining FIGS. 21 to 23 show the entire station inclusive of a transport tube or tubular member 210 on which the article M is positioned.

With initial reference to FIG. 20, the head, indicated as a whole with 200, comprises a ring 201 provided with sensors 203 which may be of the optical, background suppression or any other suitable type for the application described herein. The ring 201 with its sensors 203 is carried by a plate 205 operated by a piston-cylinder actuator 207. This actuator moves the ring 201 parallel to the axis of a transport tube or tubular member 210 with function analogous to the tube or tubular member 101 described previously. In this embodiment the tubular member 210 is movable through various workstations.

Disposed coaxially to the ring 201 is a plate 211 supported by the plate 205 and movable coaxially to the ring 201 through the effect of a piston-cylinder actuator 213, for the purposes described below.

The head also includes a pair of arms 215 carrying at the ends thereof wheels 217, omitted in FIG. 20 for greater clarity of the drawing, but illustrated schematically in FIGS. 21 to 23. In these Figures the wheels 217 are shown rotated through 90° about the axis of the tubular member 210, with respect to the position they actually take with respect to said tubular member 210. The wheels 217 are carried in rotation by a motor 219 using belts, not shown, driven around pulleys 220. A piston-cylinder actuator 223 controls an oscillatory movement of the arms 215 and of the wheels 217 according to the double arrows f217, to bring the wheels 217 into contact with the tubular member 210, or to remove them therefrom, respectively. The oscillation mechanism is not visible in FIG. 20, but can be produced intuitively.

The tubular member 210 may be carried by a carousel which transfers the tubular member through a plurality of operating stations, including the station 200 described herein. The carousel may include a plurality of tubular members or transport tubes 210, to handle several articles simultaneously.

When the tube 210 is positioned in the station 200, in a previous station the article M has already been inserted with the elastic edge B over the outer surface of said tubular member, with known means, for example equivalent to those described in the previously illustrated embodiment. The wheels 217 are made to oscillate with the arms 215 through the effect of the actuator 223 and made to rotate by the motor 217 in the direction indicated by the arrows in FIG. 21. The article M which is engaged between the tubular member 210 and the wheels 217, coated or produced with a material with a high friction coefficient, is removed from the inside of the tubular member 210 and arranged over the outer surface thereof.

During this operation, or in advance thereof, the actuator 207 carries the ring 201 to the position shown in FIG. 22, with the sensors 203 around the end of the tubular member 210. In this layout the sensors 203 detect the instant in which the end of the toe of the article M starts to come out from the tubular member 210, as shown in FIG. 22. In fact, this figure shows the band F surrounding the end of the toe of the article M which starts to come out from the tubular member 210.

During pulling of the article onto the outside of said tubular member 210 using the wheels 217, to prevent the band F from slipping beyond the end edge of the tubular member and being disposed around the outer surface thereof, when the sensors 203 detect initial projection of the band F they activate the actuator 213, which pushes the plate 211 against the front end of the tubular member 210 to block the band F against it, preventing the complete removal thereof.

This layout is shown in FIG. 23. Here the wheels 17 continue to stretch the article M, the toe of which is held by the plate 217.

At the end of the stretching operation, the plate 217 is removed to allow the successive angular positioning operations of the article M in the manner described below.

To understand how this orientation takes place in the example illustrated herein, reference should be made to FIGS. 24A-24D, which schematically show the front end of the tubular member 210, with the article M inserted thereover and the elastic band F surrounding the end of the toe which is disposed, as in the previous embodiments, with a portion F1 along a chord of the circular edge of the tubular member 210, and with the remaining portion F2 along the side surface of said tubular member 210. The pocket S of the toe P of the article M is disposed symmetrically with respect to a plane containing the axis of the tubular member 210 and essentially orthogonal to the portion F1 of the band F surrounding the toe P of the article to be sewn.

Figure 24A:
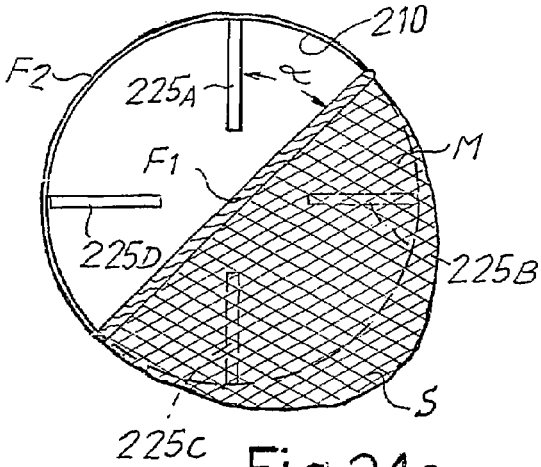

In FIG. 24A the article M is in a random position with respect to the tubular member 210. Disposed inside the latter are four extractable tabs 225A, 225B, 225C, 225D, the objects of which are explained hereunder. The object of the operations described hereunder is to dispose the article M in a specific position with respect to the tabs 225A-225D, to be subsequently engaged in and removed by systems for inserting the article into the guillotine or guide of a sewing machine, with the pocket S of the toe P correctly oriented with respect to the sewing line.

Figure 24B:
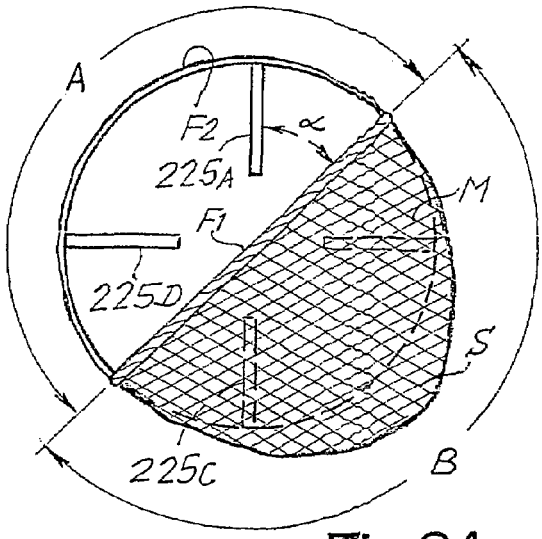

For this purpose, the first operation in the station 200 is to rotate the tubular member 210 through 360° about the axis thereof to return it to the position in FIG. 24B, identical to the position in FIG. 24A. In this rotation one or more sensors 203 are used to identify the position of the band F and, more specifically, the angular position in which the pocket S is disposed is verified using a method essentially analogous to those described hereinbefore. In practice, one or more sensors 203 read the position of the portion F2 of the band F and determine in which of the two angles A and B (in this example both 180°) the pocket S is located. In the example shown, it is in the area of angle B and offset by an angle a with respect to the position (known) of the tab 225A.

Supposing that the final angular position to be taken by the pocket S on the tubular member 210 is at the level of the tab 225A (although any one of the tabs may be taken as reference), the article M must be made to rotate by an angle equal to 90°+α about the axis of the tubular member 210. For this purpose, in the station 200 or in the phase to transfer the tubular member 210 from the station 200 to a subsequent station, the tubular member is made to rotate through 90°+α and takes the angular position in FIG. 24C.

Figure 24C:
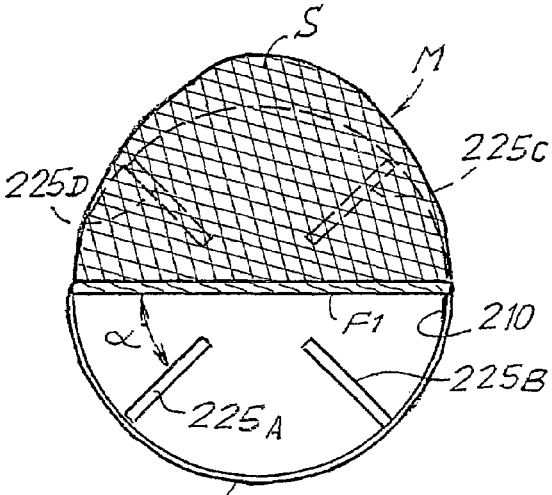
Figure 25:
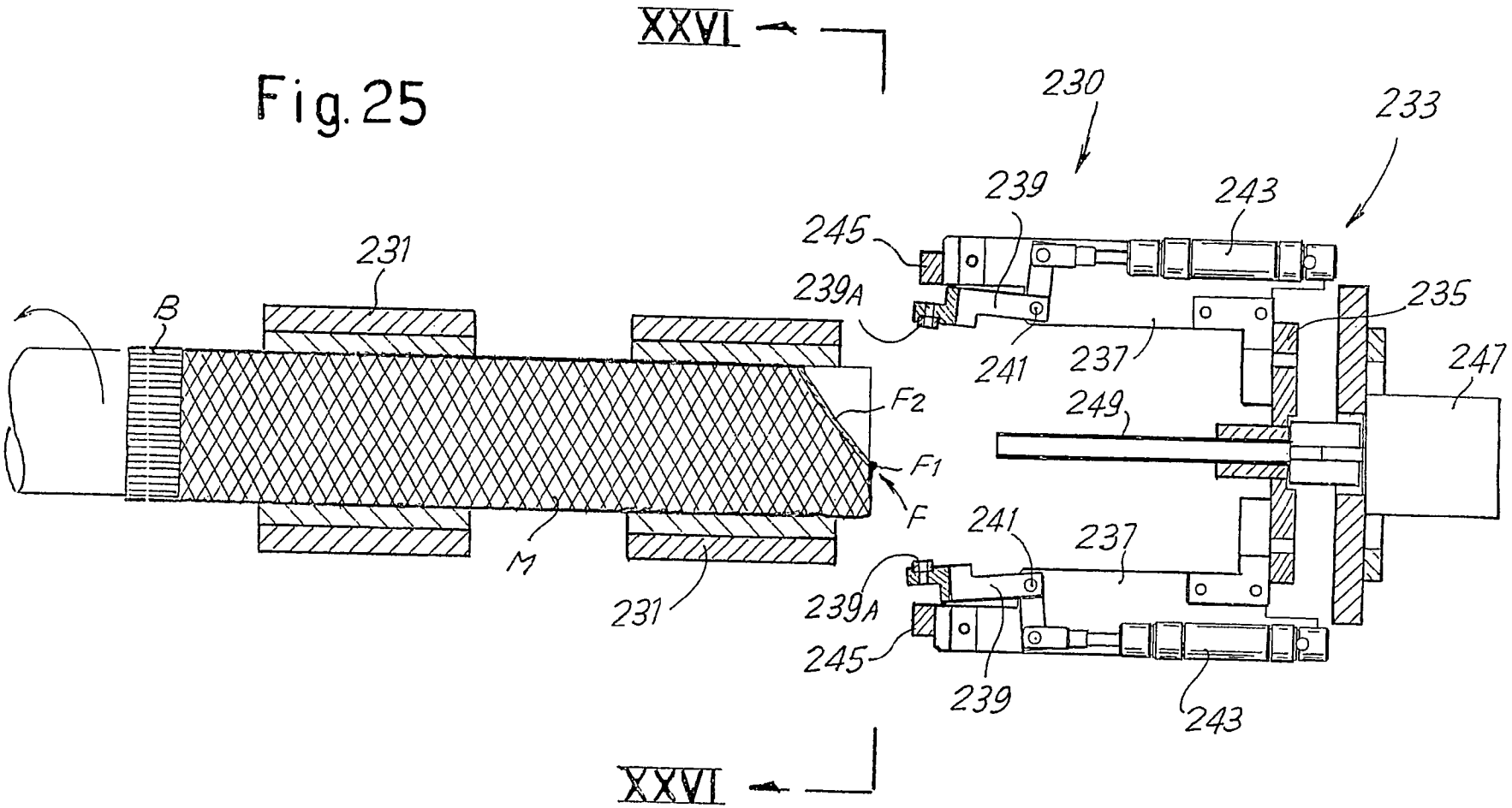
Figure 26:
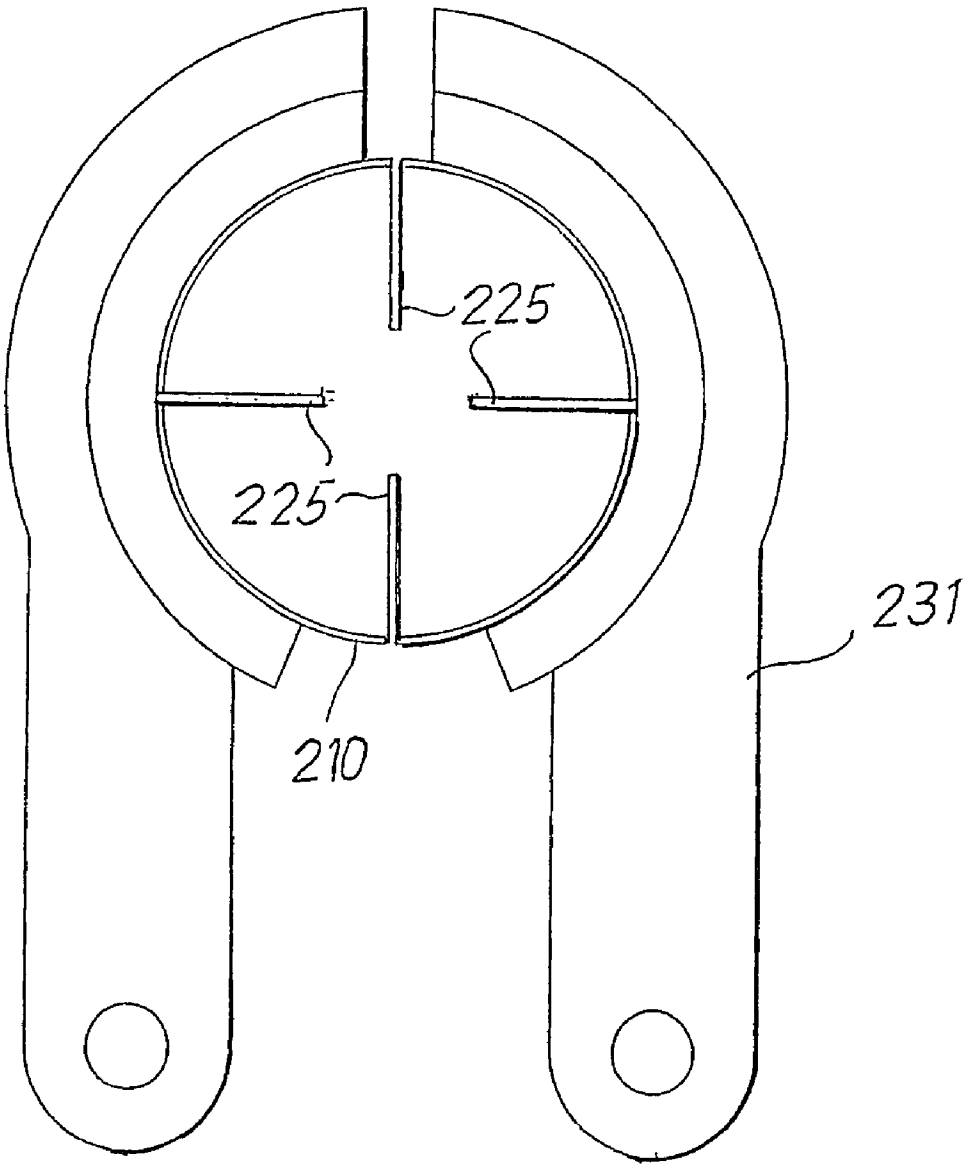
Figure 27:
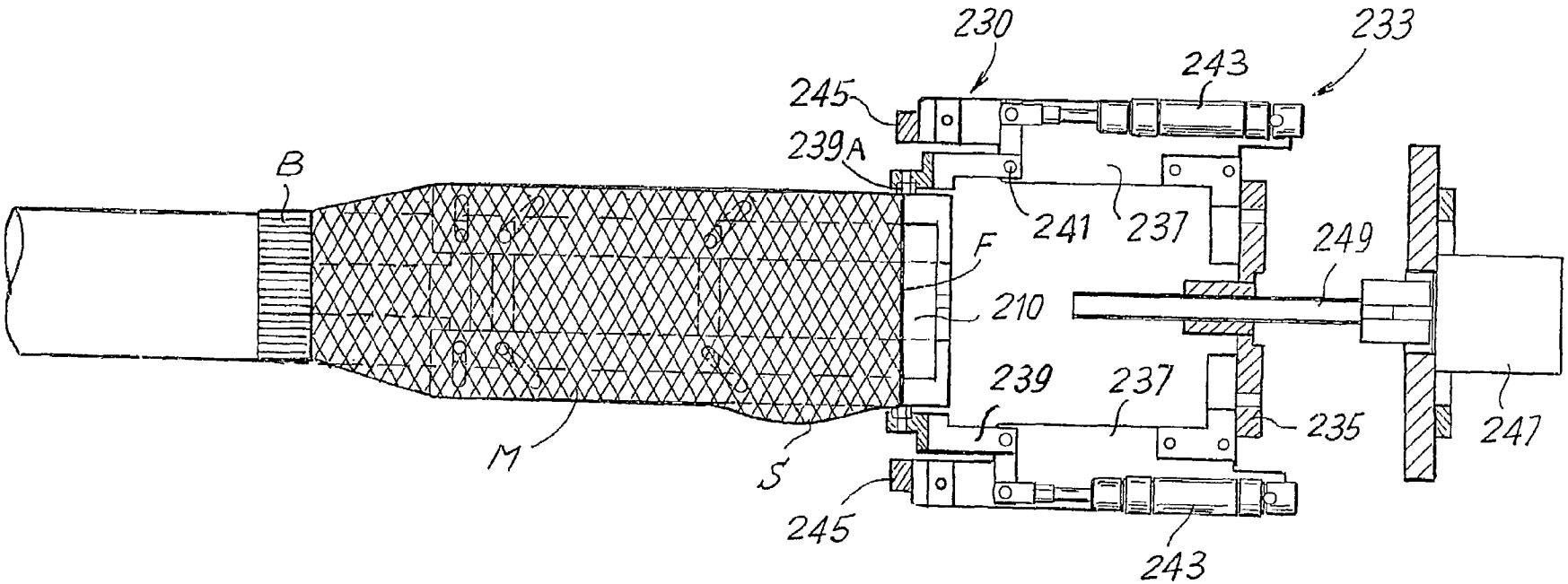

The subsequent station, indicated as a whole with 230 in FIGS. 25 to 27, has two pairs of jaws 231 which close around the tubular member with-holding (thanks to their friction coefficient) the article M, while the tubular member 210 is rotated through 90°+α in the opposite direction from the direction of the previous rotation of the same degree (passage from FIG. 24B to FIG. 24C). The tab 225A is thus returned to the initial position (FIG. 24A), while the article M, held by the jaws, remains in the original position (FIG. 24C). The pocket S of the toe P is thus centered with respect to the tab 225A.

The station 230 has a head 233 (FIG. 25, 26, 27), with an aligning member 235 which has the function of aligning the band F along a line lying approximately on a plane essentially orthogonal to the axis of the tubular member 210, unloading the portion F1 of said band from the circular front edge of the tubular member 210. This aligning member 235 has four arms 237, disposed at 90° from one another and in phase with the tabs 225A, 225B, 225C, 225D. Only two of said arms 237 are shown in the figures in order to simplify the drawing. Each arm 237 carries an oscillating lever 239 hinged in 241 to the respective arm 237 and equipped with a front pad 239A. An actuator 243 operates each of the levers 239. Moreover, each arm 237 carries a sensor 245 analogous to the sensors 203.

The entire aligning member 235 is equipped with a translatory movement parallel to the axis of the tubular member 210, controlled by a stepping motor 247 and by a screw 249.

Figure 24D:
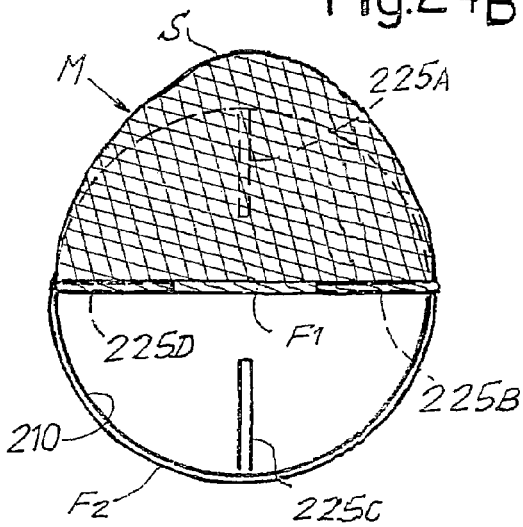
Figure 24E:
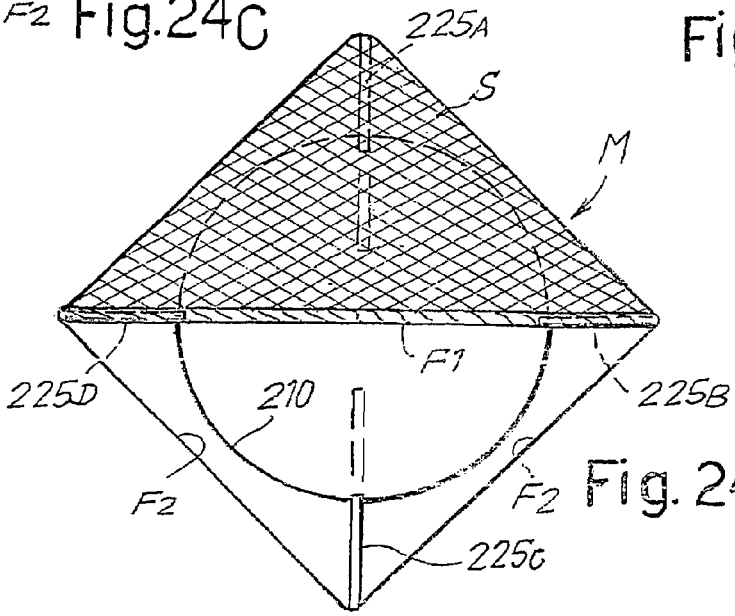

When the tubular member 210 is in the station 230, as shown in FIG. 25, and the article M has been oriented angularly as shown in FIG. 24D, the aligning member 235 is operated to make the portion F1 of the elastic band F surrounding the opening of the toe P of the articles slide from the front edge of the tubular member to the side surface thereof. For this purpose the aligning member 235 is made to translate towards the tubular member 210 by means of the motor 247, until the sensor 245 associated with the arm 237 aligned with the tab 225A identifies the presence- of the fabric. When this occurs, a signal is generated which, by means of a control unit, not shown, controls oscillation of the respective lever 239 towards the surface of the tubular member 210. The pad 239A grips the fabric of the article M and, continuing movement of the aligning member 235 towards the tubular member 210, causes the portion F1 of the band to be unloaded onto the side surface of the tubular member 210.

Continuing to reciprocally move the tubular member 210 and aligning member 235 towards each other, as the remaining three sensors 245 detect the presence of the fabric of the article M they control oscillation of the respective lever 239 towards the tubular member 210. In this way, the band F of the article M is engaged in four positions by the four levers 239 which align these positions and therefore the entire band F on a plane approximately orthogonal to the axis of the tubular member.

Instead of sliding the article M onto the outer surface of the tubular member 210 the entire operation can be performed on the edges of the four tabs 225A-225D, which can be extracted in advance with respect to the movement of the aligning member 235, to take the position shown in FIG. 27. This position is anyhow taken if the tabs are extracted after the aligning member 235 has completed its aligning function. The position in FIG. 27 is also shown in a schematic front view in FIG. 24E.

Subsequently, the head 233 is moved away from the tubular member 210, after opening the levers 239, to allow transfer of the tubular member 210 towards a subsequent station, in which the article is taken from the tubular member and inserted into a guide or guillotine of a sewing machine.

Instead of a tubular member which moves through various stations, it would be also possible to have a fixed tubular member and several operating units or stations which move with respect thereto.

It is understood that the drawing merely shows an example provided purely as a practical demonstration of the invention, the forms and arrangements of which may vary without however departing from the scope of the concept on which the invention is based.

The invention claimed is:

1. Method for handling a tubular knitted article comprising a first open end defining an elastic edge, a second open end surrounded by a band and which must be closed to form a closed toe of the article, along a closing line having specific orientation with respect to a pocket of fabric of the article; including the steps of:

stretching said article over a tubular member so that an intermediate part of the band surrounding said second end is positioned along a line intersecting in two points the end edge of the tubular member and the remaining part is disposed along the outer side surface of the tubular member;

detecting the angular position of said band on the tubular member; and identifying the position of the pocket of fabric on the basis of the angular position of said band with respect to the tubular member.

2. Method as claimed in claim 1, including the steps of:

determining the angular positions of two portions of said band adjacent to the end edge of the tubular member and disposed on the outer side surface of said tubular member; and identifying the angular position of the pocket of fabric in the intermediate area between said two angular positions.

3. Method as claimed in claim 2, wherein said tubular member is made to rotate about the axis thereof and the angular positions of said two portions of the band are determined during said rotation.

4. Method as claimed in claim 1, wherein said tubular member has a circular section and in that said intermediate portion of the band surrounding the second end of the article is disposed along a chord of the circumference defined by the end edge of the tubular member.

5. Method as claimed in claim 2, wherein said tubular member has a circular section and in that said intermediate portion of the band surrounding the second end of the article is disposed along a chord of the circumference defined by the end edge of the tubular member.

6. Method as claimed in claim 3, wherein said tubular member has a circular section and in that said intermediate portion of the band surrounding the second end of the article is disposed along a chord of the circumference defined by the end edge of the tubular member.

7. Method as claimed in claim 1, wherein the position of said band is detected by means of an optical detection system.

8. Method as claimed in claim 1, wherein the tubular member is disposed in an angular position defined as a function of the position of the pocket of fabric, the tubular article being picked up by the tubular member when said tubular member has reached said specific angular position.

9. Method as claimed in claim 1, including the steps of:

arranging at least a first sensor at a first distance from the end edge of the tubular member;

rotating said tubular member and said first sensor with respect to each other about the axis of the tubular member with the tubular article inserted over the tubular member, until two portions of said band pass in front of said first sensor, determining the angular positions of said two portions on the tubular member;

identifying the angular position of the pocket of fabric in the intermediate angular position between the two angular positions of said two portions of said band.

10. Method as claimed in claim 9, including the steps of: arranging a second sensor at a second distance from the end edge of the tubular member; and discerning between two possible diametrically opposed angular positions of said pocket of fabric using the combined detection of said two sensors.

11. Method as claimed in claim 1, wherein said band surrounding the opening of the second end of the article is of a different color to the color of the fabric adjacent to said band.

12. Method as claimed in claim 1, wherein the beginning and end of the fabric surrounding the tubular member is detected at the terminal end of said tubular member.

13. Method as claimed in claim 1, wherein the angular position of said band is detected by means of at least one distance sensor.

14. Method as claimed in claim 1, wherein the angular position of said band is detected by means of at least one electrical contact cooperating with said tubular member.

15. Method as claimed in claim 1, wherein a plurality of sensors are disposed around the axis of said tubular member, in proximity to said end edge of the tubular member, and in that said sensors and said tubular member are rotated reciprocally about the axis of the tubular member, to determine the angular position of the band of the article of the tubular member.

16. Method as claimed in claim 15, including the steps of:

activating said sensors;

identifying the sensors closest to the band of the article and facing an area of the tubular member covered by the fabric of the article;

using at least one of said sensors closest to the band of the article, to determine the angular position of the band on the tubular member with a movement of reciprocal rotation between the tubular member and said sensors about the axis of the tubular member.

17. Method as claimed in claim 1, wherein the tubular member is rotated together with the article to take said pocket of fabric to a predetermined angular position and in that the tubular member is rotated with respect to the article to take said tubular member to a predetermined angular position, with the pocket in a predetermined position with respect to the tubular member.

18. A device for angular orientation of tubular knitted articles, comprising: a tubular member; means to insert and stretch a tubular knitted article over the outside of said tubular member; a control unit; including: at least one sensor positionable to the side of said tubular member in proximity to an end edge and capable of recognizing the fabric of the tubular article; an actuator to reciprocally rotate the tubular member and said at least one sensor about the axis of the tubular member; said control unit being programmed to determine the angular position of the tubular article on the basis of the signal of said sensor.

19. Device as claimed in claim 18, wherein said at least one sensor is an optical sensor.

20. Device as claimed in claim 18, wherein said at least one sensor is a distance sensor.

21. Device as claimed in claim 18, wherein said at least one sensor comprises an electrical contact cooperating with the tubular member, said tubular member being produced in electrically conductive material, said tubular member and said sensor being disposed in an electric circuit, the contact between the sensor and the tubular member closing said electric circuit to produce a signal.

22. Device as claimed in claim 18, including a plurality of sensors positionable about the axis of the tubular member.

23. Device as claimed in claim 19, including a plurality of sensors positionable about the axis of the tubular member.

24. Device as claimed in claim 20, including a plurality of sensors positionable about the axis of the tubular member.

25. Device as claimed in claim 21, including a plurality of sensors positionable about the axis of the tubular member.

26. Device as claimed in claim 18, wherein said sensors are disposed on a plane essentially orthogonal to the axis of the tubular member.

27. Device as claimed in claim 18, wherein said control unit is programmed to perform the following steps:

activate said sensors;

identify the two sensors closest to the band of the article inserted over the tubular member and disposed in positions in which the tubular member is covered by the fabric of the article;

use at least one of said two sensors to identify the angular position of the tubular article.

28. Device as claimed in claim 18, including an element to clamp the band surrounding the toe of the article, to prevent said band from being positioned entirely along the side surface of the tubular member before detection of the toe pocket.

29. Device as claimed in claim 17, wherein said at least one sensor is carried by a support coaxial to the tubular member, said support and said tubular member being rotatable with respect to each other, and in that disposed on said support is an engaging member of the tubular article, operable to engage the tubular article and cause rotation thereof with respect to the tubular member when the support and the tubular member rotate with respect to each other.

30. Device as claimed in claim 18, including an engaging member of the tubular article, to hold the tubular article in a predetermined position while the tubular member rotates therewithin, or to rotate the tubular article about the tubular member, holding the latter still.

31. Device as claimed in claim 30, including at least two stations, said sensor(s) being disposed in a first station and said engaging member of the tubular article being disposed in a second station.

32. A method for handling an article, the method comprising:

providing a tubular knitted article, said tubular knitted article including an edge defining a first open end and a band defining a second open edge for forming a closed toe of said article along a closing line having a predetermined orientation with respect to a pocket of fabric of said article;

providing a tubular member having an outer side surface, said tubular member having a defined axis;

stretching said article over said tubular member such that a portion of said band of said article is positioned along a line intersecting an edge of said tubular member at two points, whereby another portion of said band of said article is disposed along said outer side surface of said tubular member;

arranging a plurality of sensors about said axis of said tubular member;

sensing angular position of said band with respect to said tubular member via said plurality of sensors;

identifying angular position of said pocket of fabric based on signals received from said plurality of sensors.

33. A device for angularly orienting a tubular knitted article, the device comprising:

a tubular knitted article;

a tubular member having an outside surface and a defined axis;

a means for inserting and stretching said tubular knitted article over said outside surface of said tubular member;

a plurality of sensors, said plurality of sensors being arranged about said axis of said tubular member, said sensors and said knitted article being movable with respect to one another, said sensors generating signals based on position of said tubular knitted article;

a control unit associated with said plurality of sensors, said control unit determining angular position of said tubular article based on said signals received from said sensors.

* * * * *